US011520275B2

(12) United States Patent
Kitan

(10) Patent No.: US 11,520,275 B2
(45) Date of Patent: Dec. 6, 2022

(54) CLEANING DEVICE CAPABLE OF SUPPRESSING THAT A SEALING MEMBER CONSTITUTES A RESISTANCE TO A ROTATIONAL OPERATION OF A SUPPORTING MEMBER FOR A CLEANING BLADE

(71) Applicant: CANON KABUSHIKI KAISHA, Tokyo (JP)

(72) Inventor: Tomonori Kitan, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/404,855

(22) Filed: Aug. 17, 2021

(65) Prior Publication Data

US 2022/0082986 A1 Mar. 17, 2022

(30) Foreign Application Priority Data

Sep. 15, 2020 (JP) ..... JP2020-155024

(51) Int. Cl.
*G03G 21/00* (2006.01)

(52) U.S. Cl.
CPC ..... *G03G 21/0029* (2013.01); *G03G 21/007* (2013.01); *G03G 21/0058* (2013.01); *G03G 2215/1661* (2013.01); *G03G 2221/0005* (2013.01)

(58) Field of Classification Search
CPC ..... G03G 21/0011; G03G 21/0029; G03G 21/007; G03G 2215/1661; G03G 15/161; G03G 15/168
USPC ..... 399/101, 350, 351
See application file for complete search history.

(56) References Cited

U.S. PATENT DOCUMENTS

| | | | | |
|---|---|---|---|---|
| 6,459,866 | B1 | 10/2002 | Meguro | 399/102 |
| 8,886,109 | B2 | 11/2014 | Chadani et al. | 399/351 |
| 10,423,117 | B2 * | 9/2019 | Takeuchi et al. | G03G 21/0029 |
| 2002/0025181 | A1 | 2/2002 | Meguro | 399/102 |
| 2013/0287439 | A1 | 10/2013 | Chadani et al. | 399/123 |
| 2015/0063864 | A1 | 3/2015 | Kitan | 399/107 |

FOREIGN PATENT DOCUMENTS

| | | |
|---|---|---|
| JP | H03-251887 | 11/1991 |
| JP | 2002-072798 | 3/2002 |
| JP | 2013-228634 | 11/2013 |

* cited by examiner

*Primary Examiner* — William J Royer
(74) *Attorney, Agent, or Firm* — Venable LLP

(57) ABSTRACT

A cleaning device includes a cleaning blade, a supporting member, a housing, a pressing member, and a sealing member. The supporting member is a metal member extended in a longitudinal direction of the cleaning blade. The supporting member includes a first flat surface portion formed along a widthwise direction, a curved surface portion bent toward a rotatable member with respect to a thickness direction of the cleaning blade, and a second flat surface portion formed along the thickness direction of the cleaning blade. As viewed in the longitudinal direction, a swing center of the supporting member is positioned on a rotation center side of the rotatable member relative to a plane including the first flat surface portion and relative to a plane including the second flat surface portion. The sealing member is provided in contact with the curved surface portion and seals between the supporting member and the housing.

11 Claims, 11 Drawing Sheets

B–B CROSS SECTION

A-A CROSS SECTION

B-B CROSS SECTION

CLEANING DEVICE CAPABLE OF SUPPRESSING THAT A SEALING MEMBER CONSTITUTES A RESISTANCE TO A ROTATIONAL OPERATION OF A SUPPORTING MEMBER FOR A CLEANING BLADE

FIELD OF THE INVENTION AND RELATED ART

The present invention relates to a cleaning device for use with an image forming apparatus, such as a copying machine, a printer, a facsimile machine, or a multi-function machine having a plurality of functions of these machines, a printer or a facsimile machines, using an electrophotographic type or an electrostatic recording type, and relates to the image forming apparatus.

Conventionally, for example, in the image forming apparatus, such as the copying machine, using the electrophotographic type, a cleaning device is used for removing toner (residual toner) remaining on an image bearing member after transferring a toner image from the image bearing member such as a photosensitive drum which is a rotatable member onto a transfer-receiving member. As the cleaning device, a cleaning device of a type in which the residual toner is scraped off from a surface of the rotating image bearing member by bringing a cleaning blade formed of an elastic member such as a rubber into contact with a surface (outer peripheral surface) of the image bearing member has been widely used.

A housing of such a cleaning device is provided with a collected toner accommodating portion for storing toner (contact) removed from the image bearing member by the cleaning blade. The cleaning blade is press-contacted to the surface of the image bearing member at an edge portion which is a free end portion thereof, and is supported by the housing in a state in which the cleaning blade is brought into intimate contact with the surface of the image bearing member.

As a supporting type in which the cleaning blade is supported, a fixed blade type and a swing blade type exist as described below. In the fixed blade type, a supporting member for the cleaning blade is fixed to the housing, and the cleaning blade is brought into intimate contact with the surface of the image bearing member by using a repelling force when the cleaning blade which is an elastic member is flexed. In the swing blade type, a supporting member for the cleaning blade is swingably supported by the housing, and the cleaning blade is brought into intimate contact with the surface of the image bearing member by pressing the supporting member by an urging force of a pressing member such as a spring.

According to the swing blade type, for example, even in the case where a fluctuation in frictional force between the free end portion of the cleaning blade and the surface of the image bearing member with use of the image bearing member is large, the cleaning blade is displaced together with the supporting member. For that reason, in the swing blade type, a fluctuation of a contact pressure of the free end portion of the cleaning blade with the image bearing member is easily suppressed.

However, in the swing blade type, the supporting member for the cleaning blade moves during operation (during image formation). For that reason, a sealing member for suppressing leakage of the collected toner from a gap between the supporting member and the housing forming the collected toner accommodating portion is required to seal the toner and to minimize the influence of the sealing member on the operation of the supporting member.

In Japanese Laid-Open Patent Application (JP-A) 2002-72798, it is provided that the repelling force is decreased more than a constitution in which the sealing member is pressed by a plane by causing a projection formed on the supporting member for the cleaning blade to bite into the sealing member and thus the influence on contact pressure of the cleaning blade is decreased.

In the constitution described in JP-A 2002-72798, in the case where a biting direction of the projection, formed on the supporting member, into the sealing member is close to a direction (tangential direction of rotation locus) perpendicular to a rotation radius direction of the supporting member, it would be considered that an effect of decreasing the repelling force when the sealing member is pressed is correspondingly obtained.

However, with an increasing angle of the above-described biting direction from the direction perpendicular to the rotational radius direction of the supporting member, a frictional resistance force between the sealing member and the projection bitten therein becomes larger than the repelling force of the sealing member. Further, this provides a resistance to a rotational operation of the supporting member, so that the sealing member does not readily follow flexibly a fluctuation in angle due to the rotation of the supporting member, and therefore, there is a liability that an unnecessary pressing force is generated in some instances at the free end portion of the cleaning blade and that a necessary pressing force decreases in some instances. By this, the pressing force of the cleaning blade against the image bearing member becomes unstable in some cases. For this reason, there is a liability that turning-up of the cleaning blade due to excessively strong pressing force of the cleaning blade and a lowering in toner removing performance due to an insufficient pressing force occur.

SUMMARY OF THE INVENTION

A principal object of the present invention is to provide a cleaning device capable of suppressing that a sealing member constitutes a resistance to a rotational operation of a supporting member for a cleaning blade while suppressing leakage of toner by the sealing member.

According to an aspect of the present invention, there is a provided a cleaning device comprising: a cleaning blade configured to remove toner from a surface of a rotatable member in contact with the surface of the rotatable member; a supporting member supporting the cleaning blade; a housing configured to swingably hold the supporting member; a pressing member provided between the supporting member and the housing and pressing the supporting member so as to press the cleaning blade against the rotatable member, wherein the supporting member is a metal member and is extended in a longitudinal direction of the cleaning blade, the supporting member including a first flat surface portion formed along a widthwise direction of the cleaning blade, a curved surface portion bent toward the rotatable member with respect to a thickness direction of the cleaning blade, and a second flat surface portion formed along the thickness direction of the cleaning blade, and wherein as viewed in the longitudinal direction, a swing center of the supporting member is positioned on a rotation center side of the rotatable member relative to a plane including the first flat surface portion and relative to a plane including the second flat surface portion; and a sealing member provided in contact with the curved surface portion and sealing between the supporting member and the housing.

Further features of the present invention will become apparent from the following description of exemplary embodiments with reference to the attached drawings.

DESCRIPTION OF EMBODIMENTS

A cleaning device according to the present invention and an image forming apparatus will be described specifically with reference to the drawings.

Embodiment 1

1. Constitution and Operation of Image Forming Apparatus

Figure 1:
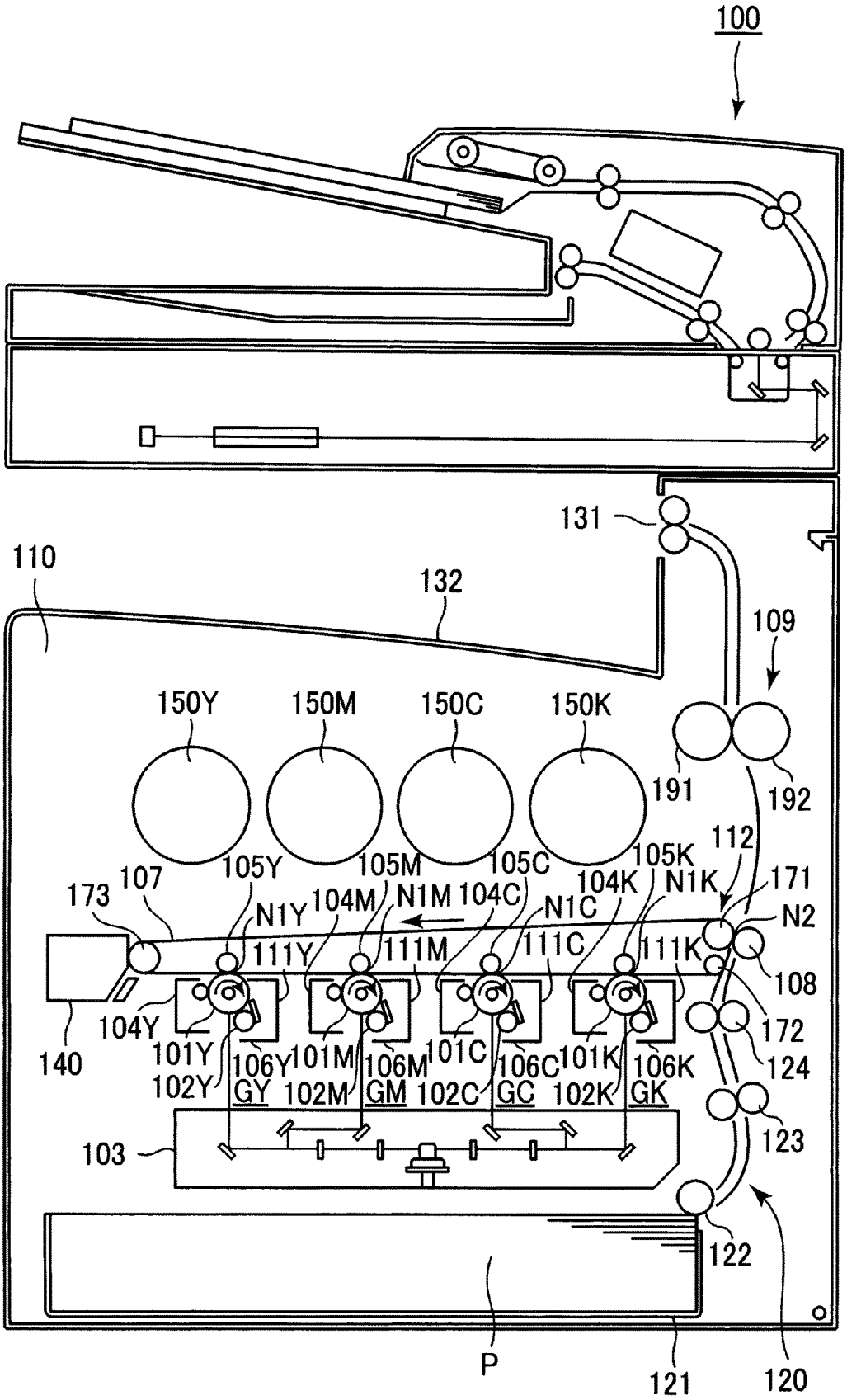
FIG. 1 is a schematic sectional view of an image forming apparatus.

FIG. 1 is a schematic sectional view of an image forming apparatus 100 according to an embodiment of the present invention. The image forming apparatus 100 of this embodiment is a tandem-type image forming apparatus (full-color laser beam printer) which is capable of forming a full-color image using an electrophotographic type and which employs an intermediary transfer type.

The image forming apparatus 100 includes, as a plurality of image forming portions (stations), first to fourth image forming portions GY, GM, GC and GK for forming toner images of yellow (Y), magenta (M), cyan (C) and black (K), respectively. In the first to fourth image forming portions GY, GM, GC and GK, as regards elements having the same or corresponding functions or constitutions, suffixes Y, M, C and K for representing elements for associated colors are omitted, and the elements will be collectively described in some instances. In this embodiment, the image forming portion G is constituted by including a photosensitive drum 101, a charging roller 102, an exposure device 103, a developing device 104, a primary transfer roller 105 and a drum cleaning device 106, which are described later.

The photosensitive drum 101 which is a drum-shaped (cylindrical) electrophotographic photosensitive member as a first image bearing member is rotationally driven in the clockwise direction in FIG. 1 at a predetermined peripheral speed (process speed). The photosensitive drum 101 is an example of a rotatable member constituting a cleaning object of a cleaning device in this embodiment. In this embodiment, the photosensitive drum 101 is prepared by forming a photosensitive layer having a negative charge polarity on an outer peripheral surface of a cylindrical aluminum cylinder. To the photosensitive drum 101, a driving force is transmitted from a driving motor (not shown) constituting a driving means provided in an apparatus main assembly 110 of the image forming apparatus 100. A surface of the rotating photosensitive drum 101 is electrically charged uniformly to a predetermined polarity (negative in this embodiment) and to a predetermined potential by the charging roller 102 which is a roller-shaped charging member. The charging roller 102 is contacted to the surface of the photosensitive drum 101 by being pressed with a predetermined pressing force to the surface of the photosensitive drum 101 by an urging means such as a spring and is rotated by rotation of the photosensitive drum 101. During the charging, to the charging roller 102, a predetermined charging voltage (charging bias) is applied from a charging voltage source (not shown) which is a high-voltage source. Further, in this embodiment, a cleaning roller 113 (FIG. 2) which is a roller-shaped charging cleaning member as a charging cleaning means is provided in contact with the charging roller 102. The cleaning roller 113 is contacted to the surface of the charging roller 102 by being pressed with a predetermined pressing force by an urging means such as a spring, and is rotated with rotation of the charging roller 102. The charged surface of the photosensitive drum 101 is subjected to scanning exposure to light depending on image information by the exposure device (laser scanner device) 103 as an exposure means (electrostatic latent image forming means) so that an electrostatic latent image (electrostatic image) is formed on the photosensitive drum 101. The exposure device 103 writes (forms) the electrostatic latent image depending on the image information on the surface of the photosensitive drum 101 by irradiating the surface of the photosensitive drum 101 with a laser beam by scanning through a rotating mirror. In this embodiment, the exposure device 103 is constituted as a single unit capable of exposing the photosensitive drums 101Y, 101M, 101C, and 101K to light. The electrostatic latent image formed on the photosensitive drum 101 is developed (visualized) with toner as a developer supplied by the developing device 104 as a developing means, so that a toner image is formed on the photosensitive drum 101. The developing device 104 uses, a two-component developer including toner (non-magnetic toner particles) and a carrier (magnetic carrier particles), and develops the electrostatic latent image by depositing the toner on the electrostatic latent image formed on the photosensitive drum 101. During development, to a developing sleeve as a developer carrying member provided in the developing device 104, a predetermined developing voltage (developing bias) is applied from a developing voltage source which is a high-voltage source. Further, in this embodiment, on an exposure portion (image portion) on the photosensitive drum 101 lowered in absolute value of the potential through exposure after being uniformly charged, toner charged to the same charge polarity of the photosensitive drum 101 is deposited (reverse development). In this embodiment, a normal charge polarity of the toner which is the toner charge polarity during development is negative. To the developing device 104, the toner is supplied from a toner bottle 150 as a toner container through a toner feeding passage (not shown).

As a second image bearing member, an intermediary transfer belt 107 which is an intermediary transfer member constituted by an endless belt is provided so as to oppose the respective photosensitive drums 101 of the respective image forming portions G. The intermediary transfer belt 107 is extended and stretched under application of a predetermined tension by, as a plurality of stretching rollers (supporting rollers), a secondary transfer opposite roller 171, a pre-secondary transfer roller 172 and a tension roller 173. The intermediary transfer belt 107 is formed in an endless shape by a dielectric resin such as polyimide. The intermediary transfer belt 107 is rotated (moved and circulated) in the counterclockwise direction in FIG. 1 by rotational drive of the secondary transfer opposite roller 171 having a function of a driving roller at a peripheral speed (process speed) substantially equal to the peripheral speed of the photosensitive drum 101. To the secondary transfer opposite roller 171, a driving force is transmitted from a belt driving motor (not shown) constituting a driving means provided in the apparatus main assembly 110. In the inner peripheral surface side of the intermediary transfer belt 107, correspondingly to the respective photosensitive drums 107, primary transfer rollers 105 which are roller-shaped primary transfer members as primary transfer means are provided. Each of the primary transfer rollers 105 is urged (pressed) against an inner peripheral surface of the intermediary transfer belt 107 toward the associated photosensitive drum 101, so that a primary transfer portion (primary transfer nip) N1 where the intermediary transfer belt 107 and the photosensitive drum 101 contact each other is formed. The stretching rollers other than the secondary transfer opposite roller 171 and the respective primary transfer rollers 105 are rotated with rotation of the intermediary transfer belt 107. The toner image formed on the photosensitive drum 101 is transferred (primary-transferred) at the primary transfer portion N1 onto the rotating intermediary transfer belt 107 by the action of the primary transfer roller 105. During a primary transfer step, to the primary transfer roller 105, a primary transfer voltage (primary transfer bias) which is a DC voltage of an oppose polarity (positive in this embodiment) to the normal charge polarity of the toner is applied from a primary transfer voltage source which is a high-voltage source (not shown). For example, during full-color image formation, the toner images, of the respective colors of yellow, magenta, cyan and black, formed on the respective photosensitive drums 101 are successively transferred superposedly onto the intermediary transfer belt 107.

In the outer peripheral surface side of the intermediary transfer belt 107, at a position opposing the secondary transfer opposite roller 171 also functioning as a secondary transfer opposite roller, a secondary transfer roller 108 which is a roller-shaped secondary transfer member as a secondary transfer means is provided. The secondary transfer roller 108 is urged (pressed) toward the secondary transfer opposite roller 171 and is contacted to the secondary transfer opposite roller 171 via the intermediary transfer belt 107, so that a secondary transfer portion (secondary transfer nip) N2 where the intermediary transfer belt 107 and the secondary transfer roller 108 contact each other is formed. The toner images formed on the intermediary transfer belt 107 are transferred (secondary-transferred), at the secondary transfer portion N2, onto a recording material P such as paper nipped and fed by the intermediary transfer belt 107 and the secondary transfer roller 108, by the action of the secondary transfer roller 108. During secondary transfer, to the secondary transfer roller 108, a secondary transfer voltage (secondary transfer bias) which is a DC voltage of the opposite polarity to the normal charge polarity of the toner is applied from a secondary transfer voltage source which is a high-voltage source (not shown). The recording materials (transfer materials, recording media, forms, sheets) P are accommodated in a recording material cassette 121 as a recording material accommodating portion. The recording materials P are fed one by one from the recording material cassette 121 by a feeding roller 122 and the like, and is conveyed to a registration roller pair 124 as a feeding member by a conveying roller pair 123 as a conveying member. The recording material P is subjected to correction of oblique movement by the registration roller pair 124 and is conveyed to the secondary transfer portion N2 by being timed to the toner images on the intermediary transfer belt 107. A feeding and conveying device 120 is constituted by the recording material cassette 121, the feeding roller 122, the conveying roller pair 123, the registration roller pair 124 and the like.

The recording material P on which the toner images are transferred is conveyed to a fixing device 109 as a fixing means. The fixing device 109 heats and presses the recording material P, on which the unfixed toner images are carried, by a fixing roller 191 provided with a heat source and by a pressing roller 192 press-contacted to the fixing roller 191, so that the toner images are fixed (melted, stuck) on a surface of the recording material P. The recording material P on which the toner images are fixed is discharged (outputted) to a discharge tray 132 as a discharge portion by a discharging roller pair 131 and the like as a discharging member.

On the other hand, toner (primary transfer residual toner) remaining on the photosensitive drum 101 after the primary transfer step is removed and collected from the photosensitive drum 101 by a cleaning device (drum cleaning device) 106 as a cleaning means (photosensitive member cleaning means) 106. Further, in the outer peripheral surface side of the intermediary transfer belt 107, at a position opposing the tension roller 173, a belt cleaning device 140 as an intermediary transfer member cleaning means is provided. That is, the belt cleaning device 140 is disposed downstream of the secondary transfer portion N2 and upstream of the primary transfer portion N1 (most upstream primary transfer portion N1Y) with respect to a surface movement direction of the intermediary transfer belt 107. A deposited matter such as toner (secondary transfer residual toner) or paper powder remaining on the intermediary transfer belt 107 after the secondary transfer is removed and collected from the intermediary transfer belt 107 by a belt cleaning device 140. In this embodiment, the cleaning device 106 includes a cleaning blade 1 (FIG. 3), formed of an elastic rubber material, as a cleaning member, and an edge portion of a free end portion of the cleaning blade is contacted to the surface of the photosensitive drum 101 at a predetermined pressing force. Then, the cleaning device 106 scrapes off and collects the primary transfer residual toner from the surface of the rotating photosensitive drum 101 by the cleaning blade 1. Similarly, in this embodiment, the belt cleaning device 140 includes a cleaning blade, formed of an elastic rubber material, as a cleaning member, and an edge portion of a free end portion of the cleaning blade is contacted to the surface of the intermediary transfer belt 107 at a predetermined pressing force. Further, the belt cleaning device 140 scrapes off and collects the secondary transfer residual toner from the surface of the intermediary transfer belt 107 by the cleaning blade. Collected matters such as the residual toners collected by the cleaning device 106 and the belt cleaning device 140 are conveyed and collected into a residual toner collecting container (not shown) via a residual toner conveying portion (not shown). The residual toner collecting container is exchanged to a blank residual toner collecting container, for example, in the case where the container becomes full or in the like case.

In this embodiment, at each of the image forming portions G, the photosensitive drum 101, the charging roller 102, the cleaning roller 113 and the cleaning device 106 integrally constitute a drum cartridge 111 (process cartridge) detachably mountable to the apparatus main assembly 110. Further, in this embodiment, the drum cartridge 111 is further provided with the cleaning roller 113. Further, in this embodiment, in each of the image forming portion G, the developing device 104 is detachably mountable to the apparatus main assembly 110 substantially alone. Incidentally, the cleaning device 106 may also be detachably mountable to the apparatus main assembly 110 integrally with at least one of the photosensitive member, the charging means, and the developing means. Further, in this embodiment, the intermediary transfer belt 107, the stretching rollers 171 to 173, the primary transfer rollers 106, and the belt cleaning device 140 integrally constitute an intermediary transfer belt unit 112 detachably mountable to the apparatus main assembly 110.

2. Drum Cartridge

Figure 2:
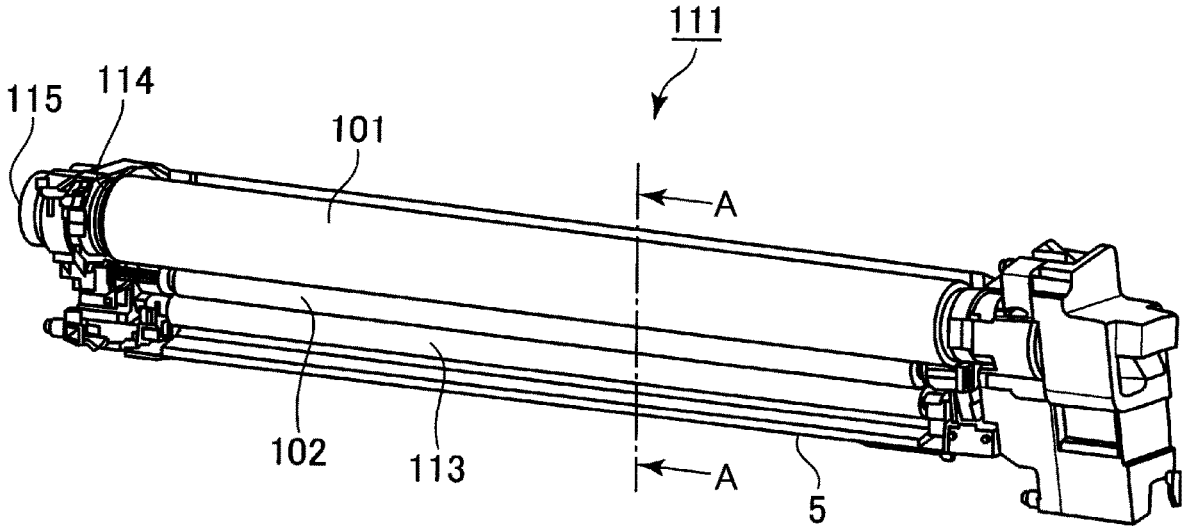
FIG. 2 is perspective view of an outer appearance of a drum cartridge.
Figure 3:
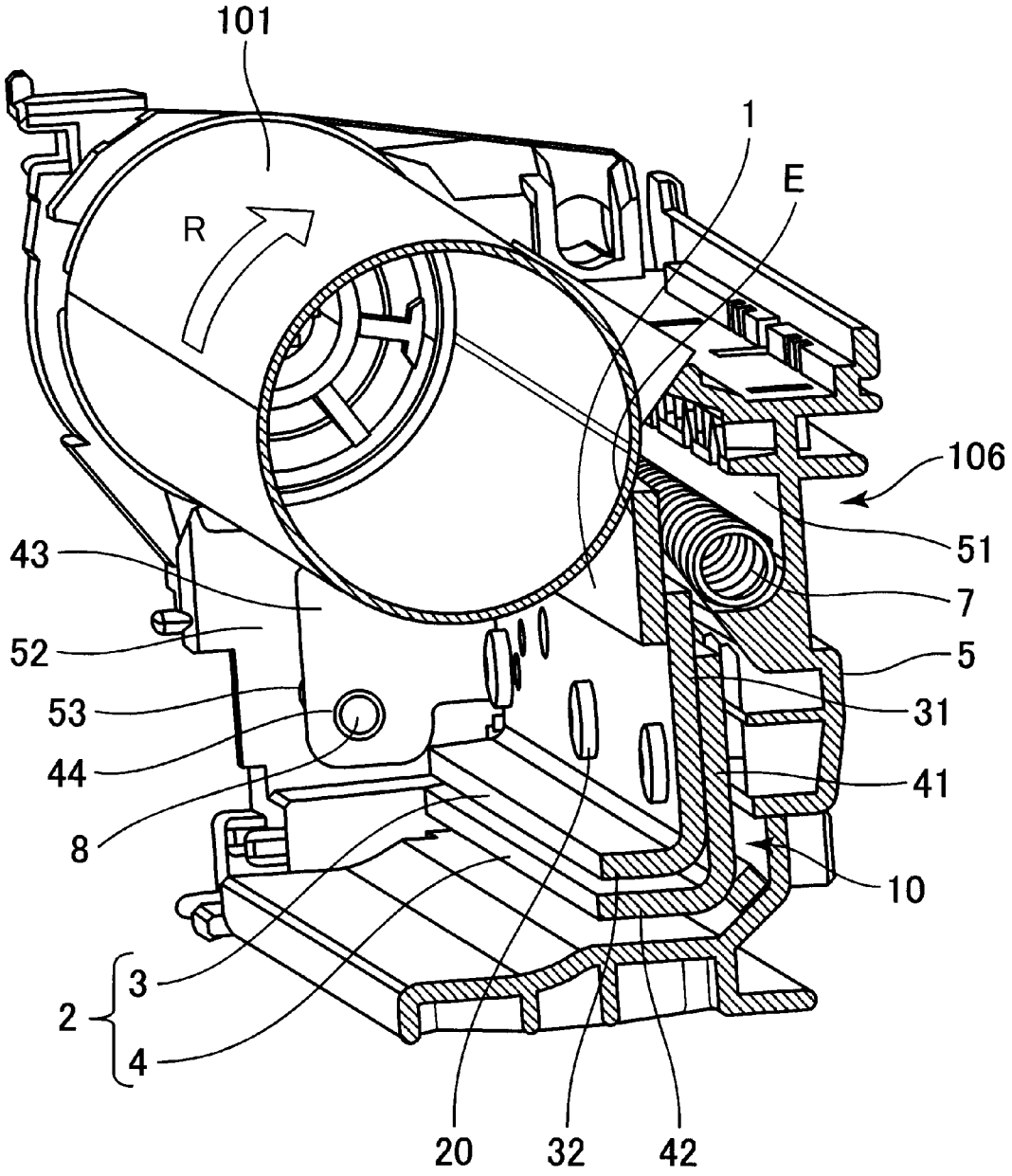
FIG. 3 is a perspective view of a cross section of the drum cartridge.

FIG. 2 is a perspective view of an outer appearance of the drum cartridge 111. FIG. 3 is a perspective view of a cross section of an A-A line in FIG. 2 (perspective view showing a cross section substantially perpendicular to a rotational axis direction of the photosensitive drum 101) of the drum cartridge 111 in this embodiment. Incidentally, in FIG. 3, the charging roller 102 and the cleaning roller 113 are omitted from illustration. Here, as regards the image forming apparatus 100 and elements thereof, a front side on the drawing sheet of FIG. 1 is referred to as a "front side", and a rear side of the drawing sheet is referred to as a "rear side". A front-rear direction connecting the front side and the rear side is substantially parallel to the rotational axis direction of the photosensitive drum 101. Further, as regards the drum cartridge 111 and elements (cleaning device 106 and elements thereof and the like) thereof, a direction substantially parallel to the rotational axis direction (widthwise direction substantially perpendicular to a surface movement direction of the photosensitive drum 101) of the photosensitive drum 101 is also referred simply to as a "longitudinal direction". Further, as regards the image forming apparatus 100 and the elements thereof, an up-down direction refers to the up-down direction with respect to a direction of gravitation (vertical direction) in the case where they are disposed similarly as in a normal operation (use) state. However, the "up" and the "down" do not mean only "immediately above" and "immediately below", respectively, but include an "upper side" and a "lower side" with respect to a horizontal plane passing through a noted element or position.

The drum cartridge 111 is prepared by integrally holding the photosensitive drum 101, the charging roller 102, the cleaning device 106, the cleaning roller 113, and the like in a housing (case (casing), framework (frame), cleaning container) 5. In this embodiment, the housing 5 is formed of a resin material of PC+ABS to which a reinforcing agent is added. Incidentally, the housing 5 may be constituted by a simple member or may also be constituted by connecting a plurality of members with an appropriate fixing means.

The drum cartridge 111 is constituted as a unit so as to be mountable in and dismountable from the apparatus main assembly 110. In this embodiment, the drum cartridge 111 is constituted so that the drum cartridge 111 is dismounted from the apparatus main assembly 110 by being slid toward the front side thereof along the longitudinal direction thereof and so that the drum cartridge 111 is mounted in the apparatus main assembly 110 by being slid toward the rear side. The drum cartridge 111 is mounted in and dismounted from the apparatus main assembly 110 for maintenance, exchange, or the like. Further, the exchange of the drum cartridge 111 is performed, for example, in the case where the photosensitive drum 101 reaches an end of a lifetime thereof, or the like case.

In this embodiment, the photosensitive drum 101 is prepared by forming an organic photosensitive layer of about 30 μm in thickness on an aluminum cylinder of 30 mm in outer diameter and 360 mm in length with respect to the rotational axis direction. The photosensitive drum 101 is held at opposite end portions thereof with respect to the rotational axis direction by the housing 5 so as to be rotatable about a rotational axis thereof via a drum bearing member (not shown). At each of the opposite end portions of the housing 5 with respect to the longitudinal direction, a bearing mounting portion 54 (FIG. 4) is provided so as to support the drum bearing member. The photosensitive drum 101 is provided with a coupling 115 for receiving a driving force from a driving motor as a driving source provided in the apparatus main assembly 100. During the image formation, the photosensitive drum 101 is rotationally driven in an arrow R direction in FIG. 3.

A rotation shaft of the charging roller 102 is held by a charging roller bearing member (not shown) at each of opposite end portions thereof with respect to the rotational axis direction, whereby the charging roller 102 is supported by the housing 5 so as to be rotatable about a rotational axis thereof. The charging roller bearing member is supported by the housing 5 so as to be slidable (movable). Specifically, the charging roller bearing member is constituted so as to be movable along a direction toward the rotational axis of the photosensitive drum 101 so that the charging roller 102 can move along the direction toward the rotational axis of the photosensitive drum 101 in a plane perpendicular to the rotational axis of the photosensitive drum 101. Further, between the housing 5 and the charging roller bearing member, a charging roller pressing spring (not shown) as an urging means is provided. The charging roller pressing spring urges the charging roller 102 in the direction toward the rotational axis of the photosensitive drum 101 in the plane perpendicular to the rotational axis of the photosensitive drum 101. For that reason, the charging roller 102 is pressed and contacted to the photosensitive drum 101.

A rotation shaft of the cleaning roller 113 is held at each of opposite end portions with respect to the rotational axis direction by a cleaning roller bearing member (not shown), whereby the cleaning roller 113 is supported by the housing 5 so as to be rotatable about the rotational axis direction thereof. The cleaning roller bearing member is supported by the charging roller bearing member so as to be slidable (movable) relative to the charging roller bearing member. Further, between the charging roller bearing member and the cleaning roller bearing member, a cleaning roller pressing spring (not shown) as an urging means is provided. By this cleaning roller pressing spring, the cleaning roller 113 is pressed and contacted to the charging roller 102.

By the above-described constitution, when the drum cartridge 111 is mounted in the apparatus main assembly 110, the coupling 115 provided on the photosensitive drum 101 is connected to the driving source provided in the apparatus main assembly 110 via a coupling and the like provided in the apparatus main assembly 110. When the photosensitive drum 101 is rotated by receiving the driving force from the driving source provided in the apparatus main assembly 110, the charging roller 102 is rotated by the frictional force thereof with the photosensitive drum 101. Further, when the charging roller 102 is rotated, the cleaning roller 113 is rotated by a frictional force with the charging roller 102. Further, when the drum cartridge 111 is mounted in the apparatus main assembly 110, an electrical contact portion provided on the drum cartridge 111 and an electrical contact portion provided in the apparatus main assembly 110 are electrically connected to each other. By this, it becomes possible to apply the charging voltage to the charging roller 102.

3. Cleaning Device

Figure 4:
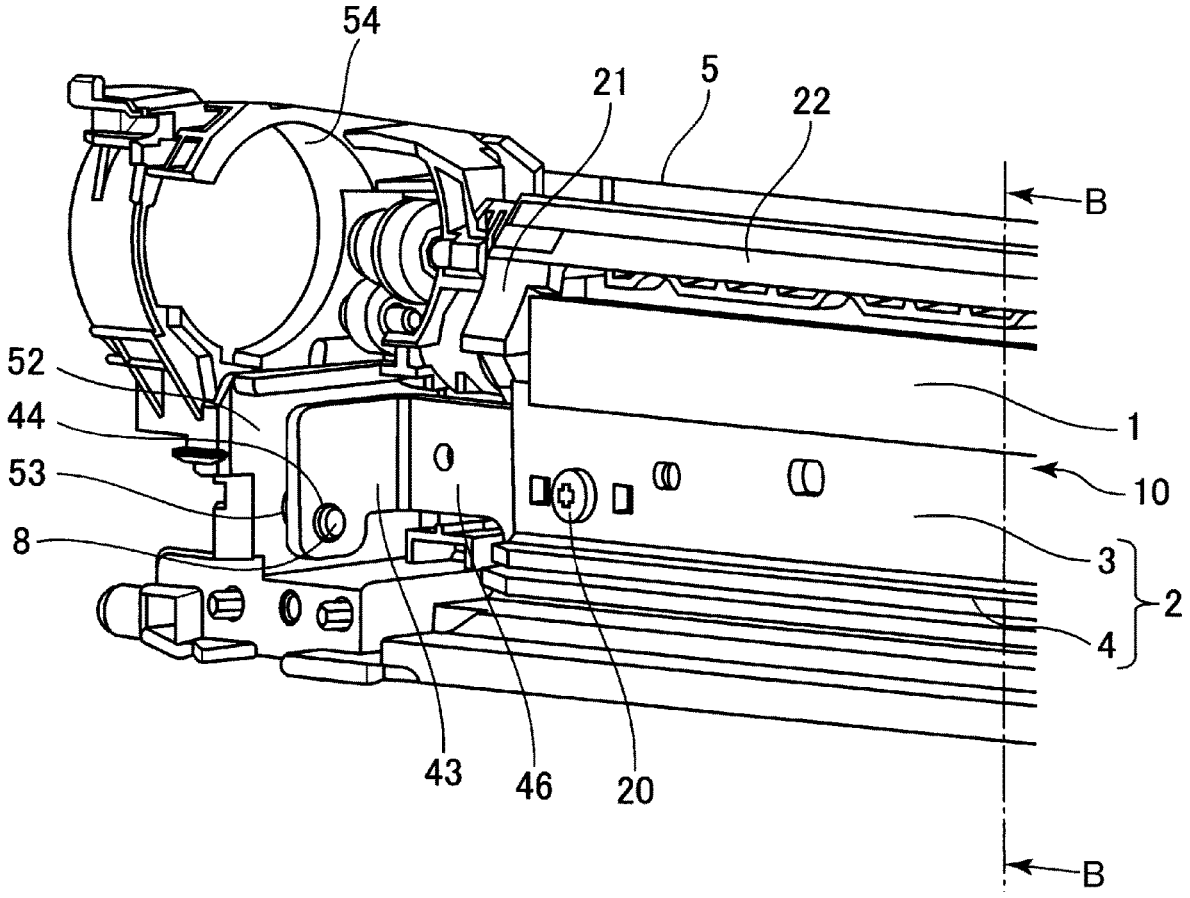
FIG. 4 is a perspective view of a principal part of a cleaning device.
Figure 5:
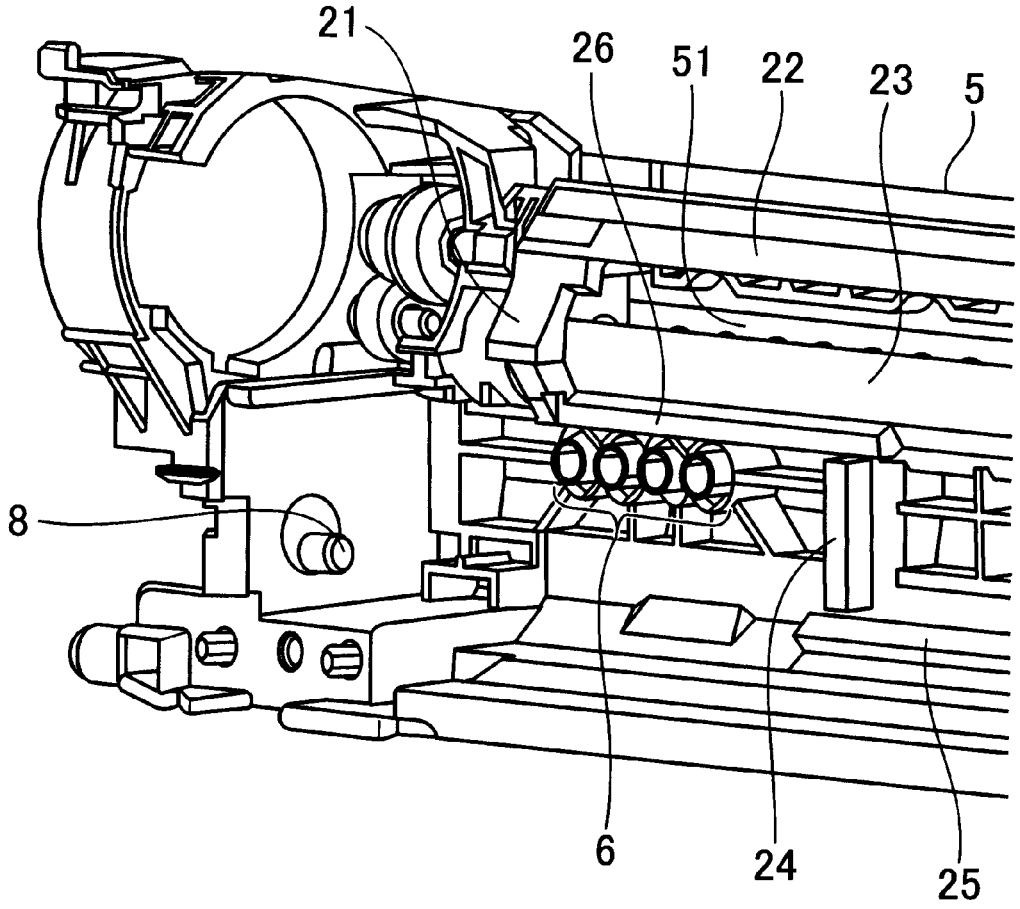
FIG. 5 is a partially perspective view of a housing.
Figure 6:
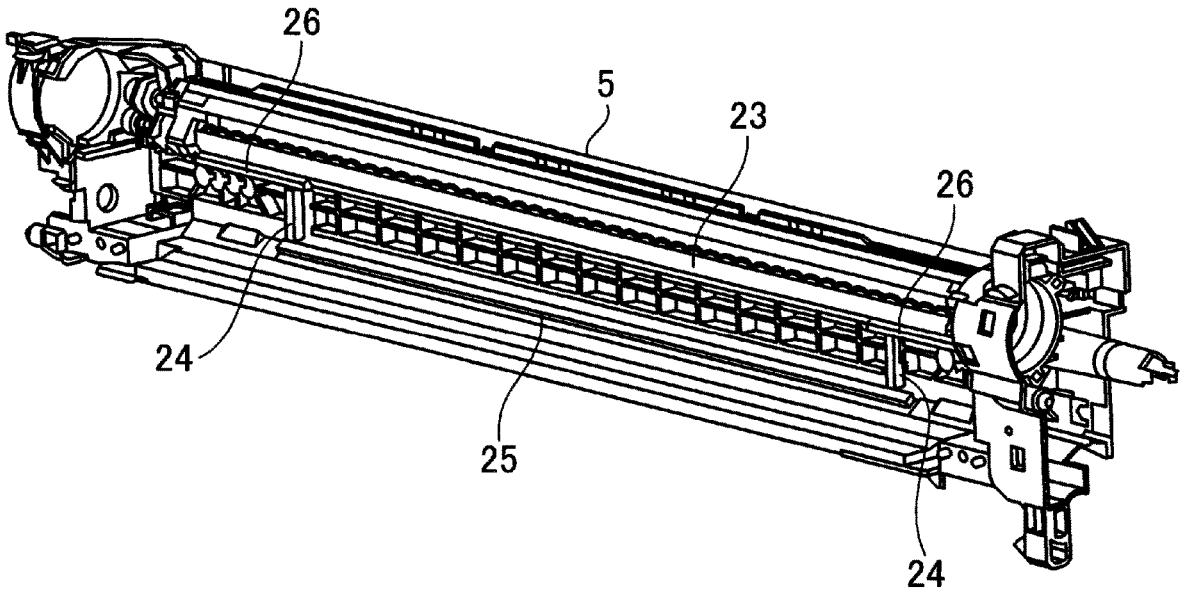
FIG. 6 is a perspective view of the housing.
Figure 7:
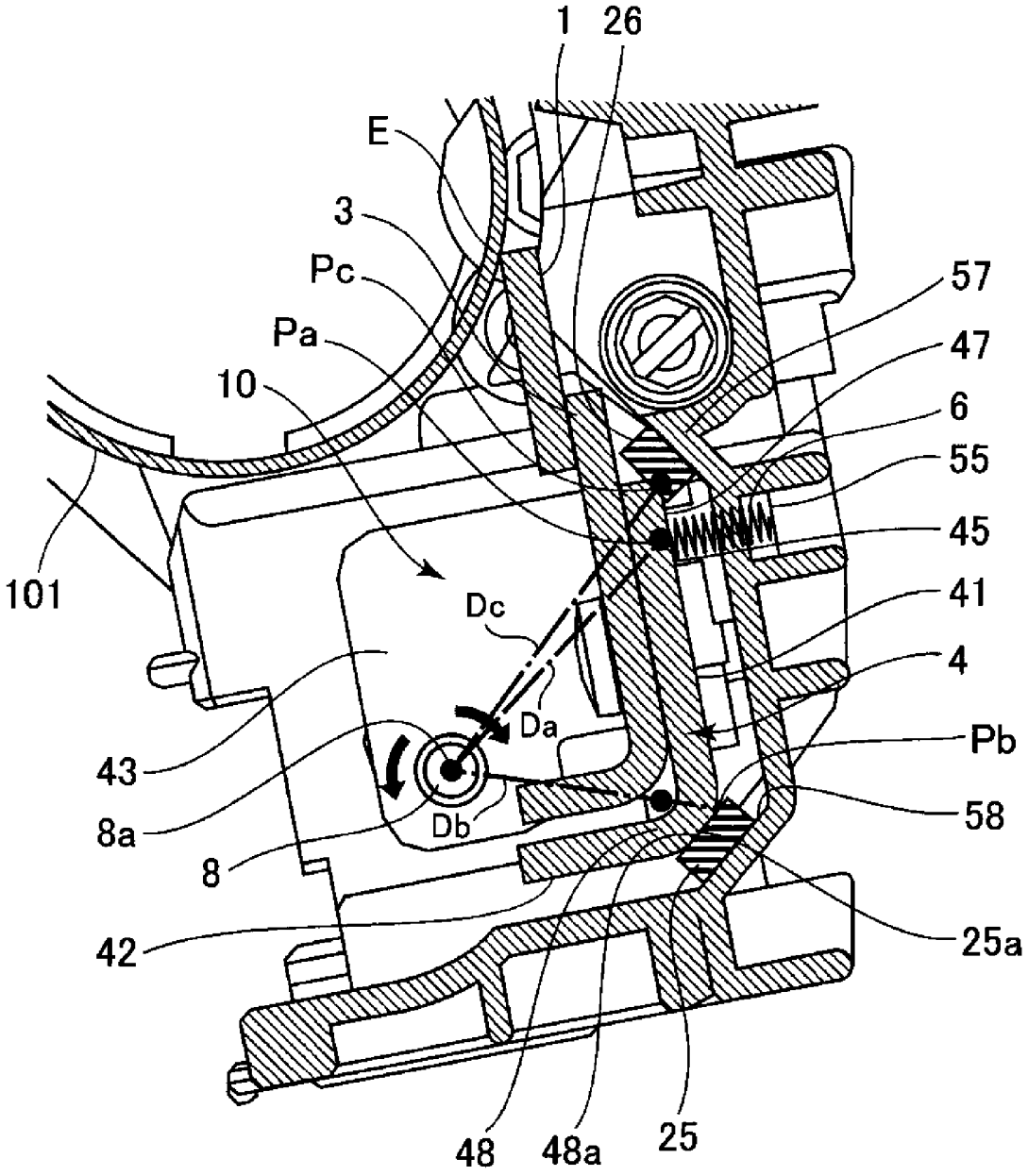
FIG. 7 is a sectional view of the cleaning device.

Next, with reference to FIGS. 3 to 7, the cleaning device 106 in this embodiment will be described. FIG. 3 is a cross-sectional perspective view (perspective view showing a cross section substantially perpendicular to the rotational axis direction of the photosensitive drum 101) of the drum cartridge 111. FIG. 4 is a partially perspective view showing the housing 5 in a state in which a blade assembly 10 described later is assembled. FIG. 5 is a perspective view of the housing 5 in a state in which the blade assembly 10 is removed. In FIGS. 4 and 5, only a constitution regarding a rear-side end portion of the housing 5 with respect to the longitudinal direction is shown, but a constitution of a principal part regarding a front-side end portion is substantially symmetrical with the constitution of the principal part regarding the rear-side end portion. FIG. 6 is a perspective view showing an entire structure of the housing 5 shown in FIG. 5. FIG. 7 is a sectional view (cross section substantially perpendicular to the longitudinal direction of the cleaning blade 1) taken along a B-B line in FIG. 4 (however, FIG. 7 shows a state in which the photosensitive drum 101 is assembled).

As shown in FIGS. 3, 4 and 7, the cleaning device 106 includes a cleaning blade 1 as a cleaning member and a supporting member 2 supporting the cleaning blade 1. In this embodiment, the supporting member 2 is constituted by including a supporting plate (first metal plate) 3 as a first supporting member and a swing plate (second metal plate) 4 as a second supporting member. Further, in this embodiment, the blade assembly (blade unit) 10 is constituted by including the cleaning blade 1, the supporting member 2 (supporting plate 3, swing plate 4). Further, the cleaning device 106 includes a blade pressing spring 6, constituted by a compression coil spring, which is a pressing member (urging member) as an urging means for pressing (urging) the cleaning blade 1 against the photosensitive drum 101 at a predetermined pressing force (urging portion) by pressing the supporting member 2. Further, the cleaning device 106 includes a collected toner accommodating portion 51 formed by the housing 5 and a feeding screw 7 as a feeding member provided in the collected toner accommodating portion 51. Further, the cleaning device 106 includes a swing shaft (swing pin) 8 as a shaft member for holding the blade assembly 10 described later so as to be swingable (rotatable) by shaft-supporting the swing plate 4 of the supporting member 2.

Incidentally, a sealing member provided on the cleaning device 106 for suppressing leakage of the toner from the cleaning device 106 will be described later.

The cleaning blade 1 is a plate-like (blade-like) member which has predetermined lengths with respect to the longitudinal direction substantially parallel to the widthwise direction (rotational axis direction) substantially perpendicular to the surface movement direction (arrow R direction in FIG. 3) of the photosensitive drum 101 and a widthwise direction substantially perpendicular to the longitudinal direction, which has a predetermined thickness. That is, the cleaning blade 1 has a substantially rectangular plate shape (blade shape) as viewed in a flat plane. In this embodiment, the cleaning blade 1 is formed with a urethane rubber (polyurethane) which is an elastic member. In this embodiment, the cleaning blade 1 is formed by cutting a 2 mm-thick urethane rubber plate material into a size of about 14 mm (widthwise direction)×325 mm (longitudinal direction). The cleaning blade 1 is disposed counterdirectionally to the rotational direction (surface movement direction) of the photosensitive drum 101, indicated by the arrow R in FIG. 3, during the image formation so that an edge portion E of a free end portion thereof with respect to the widthwise direction contacts a surface (outer peripheral surface). That is, the cleaning blade 1 is disposed so that the free end portion with respect to the widthwise direction faces toward an upstream side of the surface movement direction of the photosensitive drum 101. In this embodiment, the swing plate 4 of the cleaning blade 1 is pressed by the blade pressing spring 6 as described later, so that the edge portion E is flexed by being pressed against the surface of the photosensitive drum 101. By this, the cleaning blade 1 contacts the photosensitive drum 101 at predetermined contact pressure.

The supporting plate 3 constituting the supporting member 2 is formed by bending a metal plate so that a cross section thereof substantially perpendicular to the longitudinal direction has a substantially L-shape. That is, the supporting plate 3 is formed by bending the metal plate so as to include a first flat portion (flat surface portion) 31 and a second flat portion (flat surface portion) 32. The first flat portion 31 is disposed so that a planar direction thereof is substantially parallel to the rotational axis direction of the photosensitive drum 101. The second flat portion 32 extends from the first flat portion 31 in a direction crossing (in this embodiment, substantially perpendicular to) the first flat portion 31 and is disposed so that a planar direction thereof is substantially parallel to the rotational axis direction of the photosensitive drum 101. In this embodiment, the second flat portion 32 is disposed so as to extend from the first flat portion 31 toward the photosensitive drum 101 side. The supporting plate 3 is enhanced in rigidity by being bent as described above. The cleaning blade 1 is fixed by bonding of a part thereof on a fixing end portion side opposite from the free end portion thereof with respect to the widthwise direction to the supporting plate 3 (specifically, a part of the first flat portion 31 on an end portion side opposite from the second flat portion 32 with respect to the widthwise direction). A part of a free end portion side of the cleaning blade 1 with respect to the widthwise direction projects from the supporting plate 3 toward the photosensitive drum 101 side. In this embodiment, the cleaning blade 1 is fixed to the supporting plate 3 in a state in which the free end portion thereof with respect to the widthwise direction is projected by 8 mm (free length). Lengths of the first flat portion 31 and the second flat portion 32 of the supporting plate 3 with respect to the longitudinal direction are equal to the length of the cleaning blade 1 with respect to the longitudinal direction.

The swing plate 4 constituting the supporting member 2 is formed by bending a metal plate so that a cross section thereof substantially perpendicular to the longitudinal direction has a substantially L-shape. In this embodiment, the swing plate 4 is formed with a 2 mm-thick metal plate (zinc-plated metal plate in this embodiment). That is, the swing plate 4 is formed by bending the metal plate so as to include a first flat portion (flat surface portion) 41 and a second flat portion (flat surface portion) 42. The first flat portion 41 is disposed so that a planar direction thereof is substantially parallel to the rotational axis direction of the photosensitive drum 101. The second flat portion 42 extends from the first flat portion 41 in a direction crossing (in this embodiment, substantially perpendicular to) the first flat portion 41 and is disposed so that a planar direction thereof is substantially parallel to the rotational axis direction of the photosensitive drum 101. In this embodiment, the second flat portion 42 is disposed so as to extend from the first flat portion 41 toward the photosensitive drum 101 side. The swing plate 4 is enhanced in rigidity by being bent as described above. Further, the supporting plate 3 to which the cleaning blade 1 is fixed is fixed to the swing plate 4 with a plurality of screws 20. The plurality of screws 20 are disposed with respect to the longitudinal direction of the supporting plate 3. In this embodiment, the swing plate 4 is disposed so that a side surface of the first flat portion 41 on the photosensitive drum 101 side is disposed on a side surface of the first flat portion 31 of the supporting plate 3 on a side opposite from the photosensitive drum 101, and is fixed to the supporting plate 3. Lengths of a portion of the first flat portion 41 excluding an extended portion 46 and a holding portion 43 described later and the second flat portion 42 of the swing plate 4 with respect to the longitudinal direction are equal to the length of the cleaning blade 1 with respect to the longitudinal direction. Further, each of opposite end portions of the first flat portion 41 of the swing plate 4 with respect to the longitudinal direction are extended to outsides than an associated one of opposite end portions of the first flat portion 31 of the supporting plate 3 with respect to the longitudinal direction, so that the extended portion 46 (FIG. 4) is formed. Further, at an end portion of the extended portion 46 formed at each of the opposite end portions of the first flat portion 41 with respect to the longitudinal direction, the holding portion 43 formed by being bent so as to extend toward the photosensitive drum 101 side is provided. In this embodiment, the holding portion 43 is formed integrally with other portions (the first flat portion 41 including the extended portion 46 and the second flat portion 42) of the swing plate 4 by a single metal plate. However, the holding portion 43 may also be constituted by another member and may also be fixed to another portion of the swing plate 4. The holding portions 43 are disposed so that flat surfaces thereof extend in a direction crossing (in this embodiment, substantially perpendicular to) each of the first flat portion 41 of the swing plate 4 and the rotational axis direction of the photosensitive drum 1. Each of the holding portions 43 provided at the opposite end portions of the swing plate 4 with respect to the longitudinal direction is provided with a swing hole (through hole) 44 having a substantially circular shape in cross section (cylindrical shape) with a diameter of about 3 mm, for example. These swing holes 44 are positioned substantially coaxial with each other. Outside these holding portions 43 with respect to the longitudinal direction, side surface portions 52 which are parts of the housing 5 are provided. Each of the side surface portions 52 is provided with supporting holes (through holes) 53 having a substantially circular shape in cross section (cylindrical shape) with a diameter of about 3 mm, for example. These supporting holes 53 are positioned substantially coaxial with the above-described swing holes 44, respectively.

Each of the above-described swing holes 44 and the above-described supporting holes 53 is a through hole, and at an associated one of the opposite end portions of the housing 5 with respect to the longitudinal direction, the swing shaft 8 is inserted from, for example, the outside of the housing 5 into associated ones of the swing holes 44 and the supporting holes 53. The swing shaft 8 is engaged with the swing holes 44 and the supporting holes 53 in a state in which a gap with an engagement tolerance (for example, about 50 μm in gap) is ensured, and shaft-support the blade assembly 10. That is, the blade assembly 10 is supported by the housing 5 so as to be swingable (rotatable) about the swing shaft 8 as a supporting point (swing supporting point, swing axis, rotational axis). In this embodiment, in a cross section shown in FIG. 7, a shaft center (rotational axis, rotational center) 8*a* of the swing shaft 8 is positioned within a region where the supporting member 2 is projected on the photosensitive drum 101 side along the thickness direction of the cleaning blade 1 and within a region where the photosensitive drum 101 is projected on the supporting member 2 side along the widthwise direction of the cleaning blade 1, and is substantially parallel to the longitudinal direction of the cleaning blade 1. That is, the shaft center (rotational axis, rotation center) 8*a* of the swing shaft 8 is disposed on the rotation center side of the photosensitive drum 101 than a plane including the first flat portion 41 as viewed in the longitudinal direction of the cleaning blade 1. Further, the shaft center 8*a* (rotational axis, rotation center) 8*a* of the swing shaft 8 is disposed on the rotation center side of the photosensitive drum 101 than a plane including the second flat portion 42.

Further, as shown in FIG. 7, the blade pressing spring 6 constituted by the compression coil spring is disposed between the swing plate 4 and the housing 5. The blade pressing spring 6 is contacted to (seated on) a first contact portion 45 provided on the swing plate 4 (specifically, a side surface of the first flat portion 41 on a side opposite from the photosensitive drum 101) at one end portion thereof with respect to a coil center axis direction (expansion-contraction direction) of the compression coil spring. Further, the blade pressing spring 6 is contacted to (seated on) a second contact portion 55 provided on the housing 5 at the other end portion thereof with respect to the coil center axis direction (expansion-contraction direction). The blade pressing spring 6 at least generates a rotational force (moment) for rotating the blade assembly 10 about the swing shaft 8 as a supporting point in the counterclockwise direction in FIG. 7, and is disposed so that the cleaning blade 1 is contacted to the photosensitive drum 101. As shown in FIG. 5, in this embodiment, with respect to the longitudinal direction of the housing 5, in the neighborhood of the opposite end portions of the cleaning blade 1 with respect to the longitudinal direction, a plurality of blade pressing springs 6 each constituted by the compression coil spring are disposed in parallel to each other along the longitudinal direction of the housing 5. Particularly, in this embodiment, on each of the opposite end portion sides of the housing 5 with respect to the longitudinal direction, four blade pressing springs 6 are disposed, but the number of the blade pressing springs 6 can be appropriately changed depending on the set pressing force and an arrangement space.

As described above, the blade assembly 10 is swingable about the swing shaft 8 as the supporting point and receives a rotational force by the pressing force of the blade pressing spring 6, so that the cleaning blade 1 is press-contacted to the photosensitive drum 101. Then, the blade assembly 10 scrapes off the residual toner on the rotating photosensitive drum 101 by the edge portion E of the cleaning blade 1, so that cleaning of the surface of the photosensitive drum 101 is carried out. Thus, in this embodiment, the cleaning device 106 employs the swing blade type. By this, for example, even in the case where a fluctuation in frictional force between the free end portion of the cleaning blade 1 and the surface of the photosensitive drum 101 with use of the photosensitive drum 101 is large, the cleaning blade 1 is disposed together with the supporting member 2. For that reason, it is easy to suppress a fluctuation in contact pressure of the free end portion of the cleaning blade 1 to the photosensitive drum 101.

The residual toner scraped off of the surface of the photosensitive drum 101 by the cleaning blade 1 is accommodated in the collected toner accommodating portion 51. The collected toner accommodating portion 51 is provided in the neighborhood of the housing 5 on a side opposite from the photosensitive drum 101 with respect to the cleaning blade 1. The toner (collected toner) accommodated in the collected toner accommodating portion 51 is fed inside the collected toner accommodating portion 51 by the feeding screw 7. In this embodiment, the collected toner in the collected toner accommodating portion 51 is fed toward one end portion (for example, a front-side end portion) of the collected toner accommodating portion 51 along the rotational axis direction of the photosensitive drum 101 (the longitudinal direction of the cleaning device 106). In this embodiment, at the end portion of the photosensitive drum 101 with respect to the longitudinal direction, a gear 114 (FIG. 2) as a rotatable member fixed so as to be rotatable integrally with the photosensitive drum 101 about the rotational axis of the photosensitive drum 101 is provided. When the photosensitive drum 101 is rotated, a rotational force of the above-described gear 114 integrally rotatable with the photosensitive drum 101 is transmitted to the feeding screw 7. By this, the feeding screw 7 is rotated, so that it becomes possible to feed the collected toner in the collected toner accommodating portion 51. A wall portion of the above-described one end portion of the housing 5 is provided a discharge opening (not shown). By this, the collected toner fed inside the collected toner accommodating portion 51 is discharged to an outside of the collected toner accommodating portion 51 (the cleaning device 106) through the discharge opening. The collected toner discharged from the collected toner accommodating portion 51 is, as described above, fed through the residual toner feeding portion (not shown) provided in the apparatus main assembly 110 and is stored in the residual toner collecting container (not shown). Then, when the inside of the residual toner collecting container is filled with the collected toner, the residual toner collecting container is exchanged in its entirety. Incidentally, the discharge opening provided in the housing 5 is connected to the residual toner feeding portion provided in the apparatus main assembly 110 when the drum cartridge 111 is mounted in the apparatus main assembly 110.

4. Sealing Member (Sealing Member)

Figure 8:
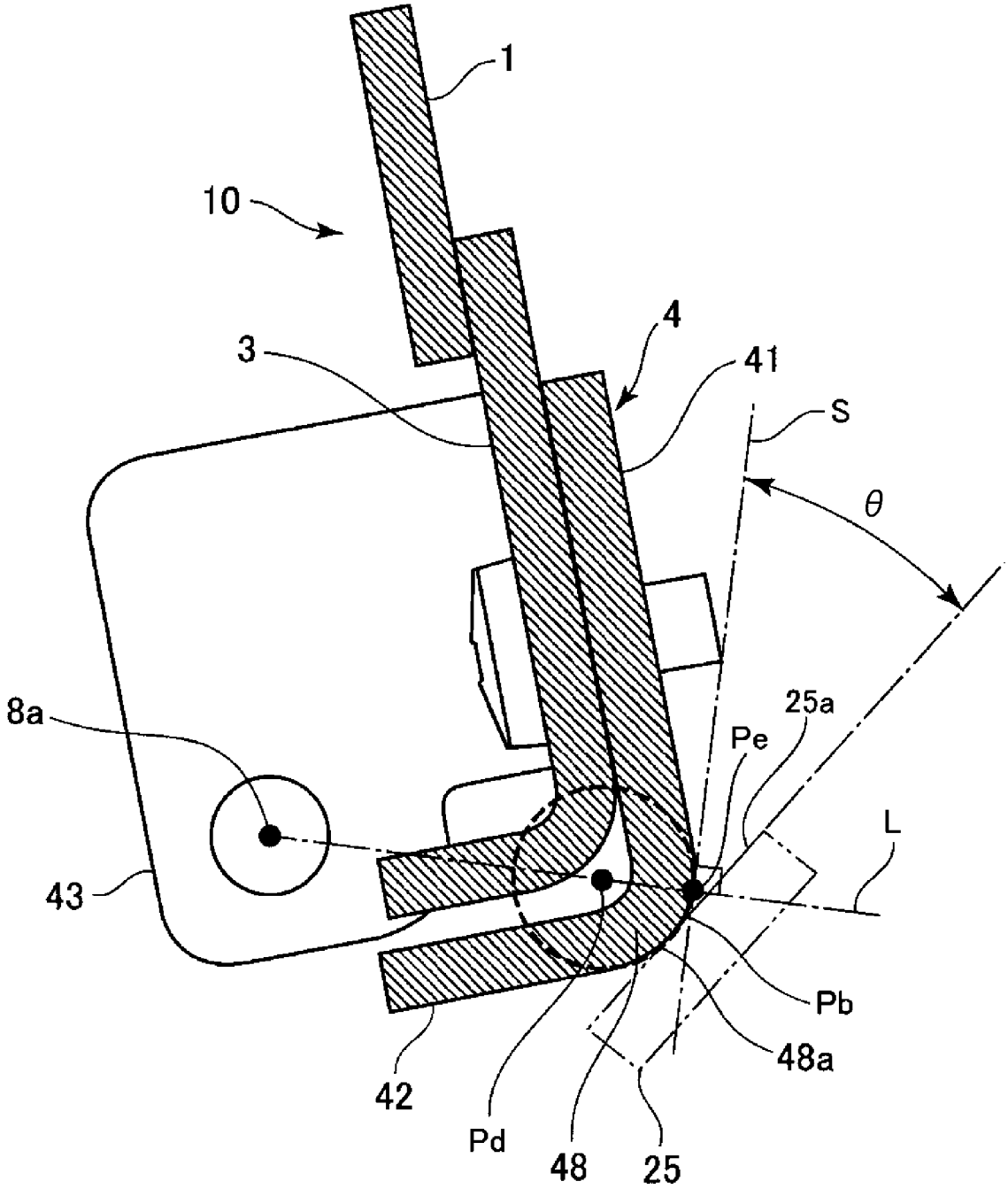
FIG. 8 is a sectional view for illustrating an arrangement of a supporting member.

Next, with reference to FIGS. 4 to 8, the sealing member (seal member) provided on the cleaning device 106 will be described. FIG. 8 is a sectional view (cross section substantially perpendicular to the longitudinal direction of the cleaning blade 1) for illustrating an arrangement of a lower longitudinal seal 25 described later.

As shown in FIG. 5, at a portion opposing the blade assembly 10 of the housing 5, the collected toner accommodating portion 51 for accommodating the toner (collected toner) collected from the photosensitive drum 101 by the cleaning blade 1 is provided. The sealing member is needed to prevent that the collected toner is leaked out, to the outside, from a region defined by the collected toner accommodating portion 51, the blade assembly 10, and the photosensitive drum 101. In this embodiment, the cleaning device 106 is provided, as the sealing member, an end portion seal 21, an upper sheet 22, an inside sheet 23, a vertical seal 24, the lower longitudinal seal 25, and a upper longitudinal seal 26.

First, the upper sheet 22 is provided along the longitudinal direction of the photosensitive drum 101. The upper sheet 22 contacts the photosensitive drum 101 at the free end portion, with respect to the widthwise direction, extending in the longitudinal direction thereof. The upper sheet 22 contacts the photosensitive drum 101 on a side upstream of the cleaning blade 1 with respect to the surface movement direction (arrow R direction in FIG. 3) of the photosensitive drum 101. Further, the upper sheet 22 is fixed to the housing 5 in intimate contact with the housing 5 by, for example, a double-side tape at a base end portion (fixed end portion) thereof opposite from the free end portion with respect to the widthwise direction. The upper sheet 22 is formed with, for example, an about 0.1 mm-thick urethane sheet and is fixed to the housing 5 in a state in which a free end portion thereof with respect to the widthwise direction projects so as to contact the photosensitive drum 101.

Further, at each of opposite end portions of the cleaning blade 1 with respect to the longitudinal direction, the end portion seal 21 is provided. Each of the end portion seals 21 contacts the photosensitive drum 101 and is disposed so as to have a predetermined gap (about 0.1 mm to 0.7 mm) between itself and the end portion of the cleaning blade 1 with respect to the longitudinal direction, and is fixed to the housing 5 in intimate contact with the housing 5 by the double-side tape, for example.

Further, the blade assembly 10 is constituted so as to be rotatable relative to the housing 5, and therefore, a space is provided between the blade assembly 10 and the housing 5. On the other hand, in order to prevent leakage of the collected toner to the outside of the collected toner accommodating portion 51, there is a need to seal this space.

For that reason, in this embodiment, the inside sheet 23 is provided along the longitudinal direction of the photosensitive drum 101. The inside sheet 23 is fixed to the housing 5 in intimate contact with the housing 5 by, for example, the double-side tape at a base end portion (fixed end portion), with respect to the widthwise direction, extending in the longitudinal direction. Further, the inside sheet 23 is disposed so that a free end portion opposite from the base end portion with respect to the widthwise direction contacts a side surface of the cleaning blade 1 on a side opposite from the cleaning blade 1. This inside sheet 23 is constituted so as not to impair the rotational operation of the blade assembly 10 and flexure of the cleaning blade 1 and so as not to form a gap between itself and the cleaning blade 1. Specifically, in this embodiment, the inside sheet 23 is formed with a thin sheet material and is fixed to the housing 5 in a state in which the free end portion thereof with respect to the widthwise direction projects so as to contact the cleaning blade 1 in a slightly flexed state. In this embodiment, as a material of the inside sheet 23, a sheet formed with a PET base material in a thickness of about 50 μm to 100 μm was used.

Here, it is difficult to constitute the cleaning blade 1 and the inside sheet 23 so as to completely seal therebetween, and thus there is a possibility that a part of the toner partially passes through between the cleaning blade 1 and the inside sheet 23.

For that reason, in this embodiment, as an auxiliary sealing member (seal member), the upper longitudinal seal 26, the lower longitudinal seal 25, and the vertical seal 24 which are described below are provided.

On a lower side of each of opposite end portions of the inside sheet 23 with respect to the longitudinal direction, the upper longitudinal seal 26 is provided adjacent to the inside sheet 23 (to which the upper longitudinal seal 26 may also be contacted). Each of the upper longitudinal seals 26 is hermetically contacted and fixed to an upper side of a mounting portion of the blade pressing spring 6 of the housing 5 by, for example, the double-side tape. Each of the upper longitudinal seals 26 extends substantially in parallel to the longitudinal direction of the housing 5 (blade assembly 10). Further, in this embodiment, each of the upper longitudinal seals 26 is constituted so that an end portion thereof on an outside (end portion side of the housing 5 with respect to the longitudinal direction) with respect to the longitudinal direction thereof is extended upward so as to be adjacent to the end portion seal 21 (this end portion may also contact the end portion seal 21).

Further, on a lower side of a central portion of the inside sheet 23 with respect to the longitudinal direction, the lower longitudinal seal 25 is provided is provided separately from the inside sheet 23. The lower longitudinal seal 25 is hermetically contacted and fixed to the housing 5 specifically at a predetermined position described later by, for example, the double-side tape. The lower longitudinal seal 25 extends substantially in parallel to the longitudinal direction of the housing 5 (blade assembly 10).

Further, at an overlapping portion, with respect to the longitudinal direction of the housing 5, a part of an end portion of the upper longitudinal seal 26 on an inside (central side of the housing 5 with respect to the longitudinal direction) of the upper longitudinal seal 26 with respect to the longitudinal direction and a part of an end portion of the lower longitudinal seal 25 on an outside (end portion side of the housing 5 with respect to the longitudinal direction) of the lower longitudinal seal 25, the vertical seal 24 is provided so as to be disposed between lower longitudinal seal 25 and upper longitudinal seal 26 with respect to the widthwise direction of the housing 5. The vertical seal 24 is hermetically contacted and fixed to the housing 5 by, for example, the double-side tape. The vertical seal 24 extends in a direction crossing (in this embodiment, substantially perpendicular to) the longitudinal direction of the housing 5 (blade assembly 10). The vertical seal 24 is adjacent to (may also be contacted to) the upper longitudinal seal 26 at one end portion thereof with respect to an extension direction, and is adjacent to (may also be contacted to) the lower longitudinal seal 25 at the other end portion thereof with respect to the extension direction.

An entire structure of the above-described auxiliary sealing members is as shown in FIG. 6. At each of the opposite end portions of the housing 5 with respect to the longitudinal direction the upper longitudinal seal 26 extending in the longitudinal direction is provided on a lower side of the inside sheet 23 and on an upper side of the blade pressing spring 6. At the central portion of the housing 5 with respect to the longitudinal direction, the lower longitudinal seal 25 extending in the longitudinal direction is provided on the lower side of the inside sheet 23. Further, the vertical seals 24 each positioned between the upper longitudinal seal 26 and the lower longitudinal seal 25 and each extending in a vertical direction (direction substantially perpendicular to the longitudinal direction) is provided. By these auxiliary sealing members, it is possible to suppress that the collected toner slightly leaked out from a contact portion between the inside sheet 23 and the cleaning blade 1 toward the lower side is leaked out to an outside of the drum cartridge 111.

In this embodiment, as materials of the upper longitudinal seal 26, the lower longitudinal seal 25, and the vertical seal 24, an urethane foam which is an elastic foam (sponge) as an elastic body (elastic member) was used. Incidentally, in this embodiment, each of the upper longitudinal seal 26, the lower longitudinal seal 25, and the vertical seal 24 has a rectangular shape in cross section substantially perpendicular to the extension direction. Each of the upper longitudinal seal 26, the lower longitudinal seal 25, and the vertical seal 24 is compressed and disposed between the swing plate 4 and the housing 5. By this, these seals can meet an increase and a decrease in gap to be sealed by utilizing a repelling force and a restoring force by the compression. Incidentally, each of the upper longitudinal seal 26, the lower longitudinal seal 25, and the vertical seal 24 may also be formed with an elastic material such as an elastic foam having a surface, contacting a sealing object, to which a brush-like member (such as a fiber-planted cloth) is attached.

Next, with reference to FIG. 7, division and disposition of the sealing member contactable to the swing plate 4 and extending in the longitudinal direction into the upper longitudinal seal 26 and the lower longitudinal seal 25 with respect to the vertical (up-down) direction will be further described. FIG. 7 is the sectional view (cross section substantially perpendicular to the longitudinal direction of the cleaning blade 1) taken along the B-B line in FIG. 4 as described above (however, FIG. 7 shows a state in which the photosensitive drum 101 is assembled).

In this embodiment, even the leakage of the collected toner in a slight amount, in order to reduce a possibility that the collected toner leaked is deposited on the blade pressing spring 6 and has the influence on an operation of the blade pressing spring 6, the upper longitudinal seal 26 is disposed at a position on the upper side of the blade pressing spring 6. However, as described below, in the case where the sealing member is disposed over an entire region with respect to the longitudinal direction thereof at this position of the upper longitudinal seal 26, there is a possibility that the sealing member has the influence on the rotational operation of the swing plate 4. Therefore, in this embodiment, the sealing member contacting the swing plate 4 and extending in the longitudinal direction is divided into the upper longitudinal seal 26 and the lower longitudinal seal 25 with respect to the vertical direction. Further, the lower longitudinal seal 25 is disposed at a predetermined position described below. By this, it is possible to alleviate a degree of the influence on the rotational operation of the swing plate 4 than in the case where the sealing member is provided at the position of the upper longitudinal seal 26 over an entire region with respect to the longitudinal direction.

As shown in FIG. 7, the swing plate 4 is rotatable about the shaft center (rotational axis, rotation center) 8*a* of the swing shaft 8 as indicated by an arrow. Further, as shown in FIG. 7, the upper longitudinal seal 26 is fixed to a wall surface 57 of the housing 5 facing an end portion 47 of the swing plate 4 on the photosensitive drum 101 side with respect to the widthwise direction of the first flat portion 41 so as to contact the end portion 47. The upper longitudinal seal 26 contacts a side surface of an edge portion of the end portion 47 on a side of the swing plate 4 opposite from the photosensitive drum 101. For that reason, in the case where the end portion 47 of the swing plate 4 bites into the upper longitudinal seal 26, the swing plate 4 is liable to constitute a resistance to the rotational operation when the swing plate 4 is rotated.

Further, the blade pressing spring 6 is disposed between the housing 5 and the swing plate 4, and imparts, to the swing plate 4, an urging force for urging the swing plate 4 toward the photosensitive drum 101 side at a load point Pa. At this time, a contact position Pc between the upper longitudinal seal 26 and the swing plate 4 is close to the free end portion side of the cleaning blade 1 than the load point Pa is. That is, in a cross section shown in FIG. 7, a distance Dc from the rotational axis 8*a* of the swing plate 4 to the contact position Pc between the upper longitudinal seal 26 and the swing plate 4 is longer than a distance (direct (linear) distance) Da from the rotational axis 8*a* of the swing plate 4 to the load point Pa of the blade pressing spring 6. For that reason, a repelling force of the upper longitudinal seal 26 generating at the above-described contact position Pc is liable to have the influence on the urging force of the blade pressing spring 6 since Da<Dc holds when a lever ratio is considered.

On the other hand, as shown in FIG. 7, the lower longitudinal seal 25 is fixed to a wall surface (hereinafter, also referred to as a "seal bonding surface") 58 of the housing 5 facing a bent portion 48, formed between the first flat portion 41 and the second flat portion 42 by bending the metal plate constituting the swing plate 4, so as to contact the bent portion 48. In this embodiment, the wall surface 58 is constituted by a flat surface. The bent portion 48 has a substantially arcuate surface 48*a* in cross section which extends substantially in parallel to the longitudinal direction of the cleaning blade 1 and which projects toward a side opposite from the photosensitive drum 101 (hereinafter, simply referred to as an "arcuate surface"). Further, the lower longitudinal seal 25 is disposed so as to contact the arcuate surface (curved surface) 48*a* of the bent portion 48. For that reason, when the swing plate 4 is rotated, the lower longitudinal seal 25 slides on the arcuate surface 48*a* of the bent portion 48 of the swing plate 4. By this, a frictional resistance can be reduced when the swing plate 4 is rotated, so that it is possible to suppress that the lower longitudinal seal 25 constitutes the resistance to the rotational operation of the swing plate 4. Further, the lower longitudinal seal 25 seals the above-described gap, to be sealed, in contact with the arcuate surface 48*a* of the bent portion 48 of the swing plate 4, and therefore, the lower longitudinal seal 25 is contacted to the swing plate 4 at different angles. For this reason, compared with the case where the lower longitudinal seal 25 contacts the flat surface portion of the swing plate 4, it becomes possible that the toner is not readily leaked out.

Further, in the cross section shown in FIG. 7, a distance (direct distance) Db from the rotational axis 8*a* of the swing plate 4 to a contact position Pb between the lower longitudinal seal 25 and the bent portion 48 of the swing plate 4 is shorter than the distance (direct distance) Da from the rotational axis 8*a* of the swing plate 4 to the load point Pa of the blade pressing spring 6. For that reason, it is possible to alleviate the influence on the urging force of the blade pressing spring 6 by the repelling force of the lower longitudinal seal 25 generating at the above-described contact position Pb.

Further, in this embodiment, of the sealing member contacting the swing plate 4 and extending in the longitudinal direction, a portion thereof which is ½ or more of the sealing member in length is constituted by the lower longitudinal seal 25. That is, the length of the lower longitudinal seal 25 with respect to the longitudinal direction is longer than a total length of the upper longitudinal seals 26 with respect to the longitudinal direction. By this, the influence by the repelling force of the sealing member can be alleviated than in the case where the upper longitudinal seal 26 is provided over an entire region with respect to the longitudinal direction.

Next, with reference to FIG. 8, the arrangement of the lower longitudinal seal 25 (seal bonding surface 58) will be further described. FIG. 8 is a sectional view (cross section substantially perpendicular to the longitudinal direction of the cleaning blade 1) for illustrating the arrangement of the lower longitudinal seal 25 as described above.

In the cross section shown in FIG. 8, a rectilinear line connecting the rotational axis 8*a* of the swing plate 4 and a curved surface center Pd which is a center of the arcuate surface 48*a* of the bent portion 48 of the swing plate 4 is a rectilinear line L. Further, in the cross section shown in FIG. 8, a rectilinear line (tangential line of an arc) perpendicular to the rectilinear line L at a point of intersection Pe of the rectilinear line L and the arcuate surface 48*a* of the bent portion 48 is a rectilinear line S. Further, in the cross section shown in FIG. 8, an angle formed by the rectilinear line S and a contact surface 25*a* of the lower longitudinal seal 25 which is a surface (flat surface) contacting the swing plate 4 is a contact angle θ. The contact angle θ can be represented by using a tangential line of the lower longitudinal seal 25 in the case where it is assumed that the lower longitudinal seal 25 is not compressed by the swing plate 4 or a tangential line of the seal bonding surface 58 of the housing 5 to which the lower longitudinal seal 25 is fixed. Further, the contact angle θ is represented by an angle in a state in which the cleaning blade 1 is contacted to the photosensitive drum 101 and in which the photosensitive drum 101 is at rest. In this case, the contact angle θ may preferably be 40° or less. That is, the seal bonding surface 58 may preferably be provided on the housing 5 so that the contact angle θ is 40° or less.

In the case where the swing plate 4 is rotated, a movement direction of the bent portion 48 is a tangential direction of a rotation locus (arcuate shape) of the swing plate 4, and therefore, the bent portion 48 moves in a direction along the rectilinear line S. For that reason, the angle formed by the rectilinear line S and the surface of the lower longitudinal seal 25, i.e., the contact angle θ is capable of reducing a sliding resistance when the contact angle θ is decreased as small as possible. That is, the case where the contact angle θ=0° is most preferred. However, for the reason of an arrangement of other members in the housing 5, in some cases, the contact angle θ=0° cannot be realized. Even in such a case, according to study by the present inventor, the contact angle θ is sufficiently small when the contact angle θ<40° holds, and therefore, it becomes possible to suppress the influence of the sliding resistance to a low level. By this, for example, even in a state in which the bent portion 48 of the swing plate 4 press-contacts and bites into the lower longitudinal seal 25, it is possible to alleviate the sliding resistance between the bent portion 48 of the swing plate 4 and the lower longitudinal seal 25 when the swing plate 4 is rotated.

Thus, in this embodiment, the cleaning device 106 includes the cleaning blade 1 which is used for removing the toner from the surface of the rotatable member 101 in contact with the surface of the rotatable member 101 and which is formed with the plate-like elastic member having the predetermined length with respect to each of the longitudinal direction substantially parallel to a width direction substantially perpendicular to the surface movement direction and a short (widthwise) direction substantially perpendicular to the longitudinal direction and having the predetermined thickness with respect to the thickness direction substantially perpendicular to the longitudinal direction and the short (widthwise) direction. Further, the cleaning device 106 includes the supporting member 2 which supports the cleaning blade 1 and which includes the swing plate 4 disposed substantially parallel to the longitudinal direction and bent toward the rotatable member 101 side at the bent portion 48 which is disposed on the end portion side opposite from the rotatable member 101 with respect to the short (widthwise) direction and which extends in the direction substantially parallel to the longitudinal direction, wherein the bent portion 48 includes the arcuate surface 48*a* having an arcuate shape in cross section substantially perpendicular to the longitudinal direction. Further, the cleaning device 106 includes the housing 5, for holding the supporting member 2 so as to be rotatable about the rotational axis substantially parallel to the longitudinal direction, positioned within a region where the supporting member 2 is projected on the rotatable member side along the thickness direction and within a region where the cylindrical member constituting the rotatable member 101 is projected on the supporting member side along the short (widthwise) direction as viewed along the longitudinal direction. Further, the cleaning device 106 includes the pressing member 6, for imparting the urging force to the supporting member 2 so as to rotate the supporting member 2 in the direction in which the cleaning blade 1 is pressed against the rotatable member 101, provided between the supporting member 2 and the housing 5. Further, the cleaning device 106 includes the lower longitudinal seal 25 provided between the supporting member 2 and the housing 5 so as to contact the arcuate surface 48*a* of the supporting member 2.

In this embodiment, in the cross section substantially perpendicular to the longitudinal direction, the distance Db from the rotational axis 8*a* to the contact position Pb between the lower longitudinal seal 25 and the arcuate surface 48*a* is shorter than the distance Da from the rotational axis 8*a* to the load point Pa where the pressing member 6 imparts the urging force to the supporting member 2. Further, in this embodiment, in the cross section substantially perpendicular to the longitudinal direction, when the rectilinear line connecting the rotational axis 8*a* and the curved surface center Pd which is the center of the arcuate surface 48*a* is the rectilinear line L, the rectilinear line perpendicular to the rectilinear line L at the point of intersection Pe of the rectilinear line L and the arcuate surface 48*a* is the rectilinear line S, and the angle formed by the rectilinear line S and the contact surface 25*a* which is the surface contacting the arcuate surface 48*a* of the lower longitudinal seal 25 is the contact angle θ, the contact angle θ is 40° or less. Further, in this embodiment, the cleaning device 106 includes upper longitudinal seal 26 provided between the supporting member 2 and the housing 5 so as to contact the supporting member 2 on the rotatable member 101 side than the arcuate surface 48*a* is with respect to the widthwise direction (short direction), and the length of the lower longitudinal seal 25 with respect to the longitudinal direction is longer than the length of upper longitudinal seal 26 with respect to the longitudinal direction. Further, in this embodiment, in the cross section substantially perpendicular to the longitudinal direction, the distance Dc from the rotational axis 8*a* to the contact position Pc between upper longitudinal seal 26 and the supporting member 2 is longer than the distance Da from the rotational axis 8*a* to the load point Pa where the pressing member 6 imparts the urging force to the supporting member 2. Further, in this embodiment, the lower longitudinal seal 25 is disposed in the region including the central portion of the supporting member 2 with respect to the longitudinal direction, and upper longitudinal seal 26 is disposed at each of the opposite end portions of the supporting member 2 with respect to the longitudinal direction. Further, in this embodiment, on each of the opposite end portion sides of the supporting member 2 with respect to the longitudinal direction, the vertical seal 24 provided the lower longitudinal seal 25 and upper longitudinal seal 26 with respect to the widthwise direction is disposed between the supporting member 2 and the housing 5. Further, in this embodiment, the supporting member 2 is constituted by including the above-described swing plate 4 and supporting plate 3 which is fixed to the metal plate 4 and to which the cleaning blade 1 is fixed. Further, in this embodiment, the rotatable member 101 is a cylindrical photosensitive member. Further, in this embodiment, there is provided an image forming apparatus capable of forming an image on a recording material P and including the rotatable member 101 and the above-described cleaning device 106. Further, in this embodiment, the rotatable member 101 and the cleaning device 106 are included in the drum cartridge 111 capable of being mounted in and dismounted from the image forming apparatus 100.

As described above, the lower longitudinal seal 25 which is the sealing member contacting the swing plate 4 and extending in the longitudinal direction is contacted to the arcuate surface 48*a* of the bent portion 48 of the swing plate 4 closer to the rotation supporting point of the swing plate 4 than the blade pressing spring 6 for the swing plate 4 is. By this, an effect of not only reducing the repelling force of the lower longitudinal seal 25 with respect to the compression direction but also reducing the sliding resistance generating with respect to the rotational direction of the swing plate 4. For that reason, it becomes possible to decrease the influence of the lower longitudinal seal 25 on the urging force of the blade pressing spring 6 while maintaining an intimate contact force between the swing plate 4 and the lower longitudinal seal 25 suppressing leakage of the collected toner. By this, it is possible to obtain an effect of reducing a degree of turning-up of the cleaning blade 1 and a degree of remaining of the residual toner due to a lowering in residual toner removing performance by improving stability of the rotational operation of the blade assembly 10. Accordingly, according to this embodiment, in the cleaning device employing the swing blade type, it is possible to suppress that the sealing member constitutes the resistance to the rotational operation of the supporting member for the cleaning blade, while suppressing leakage of the toner by the sealing member.

Incidentally, in this embodiment, the sealing member contacting the swing plate 4 and extending in the longitudinal direction is constituted by including the upper longitudinal seal 26 and the lower longitudinal seal 25, but the present invention is not limited to such an embodiment. For example, in a constitution in which necessity of suppressing deposition of the collected toner on the blade pressing spring 6 by the sealing member (in a constitution in which the collected toner deposition is suppressed by the shape of the housing 5 or the like), only the lower longitudinal seal 25 may also be provided without providing the upper longitudinal seal 26. In this case, for example, the lower longitudinal seal 25 is extended to each of the longitudinal end portions of the housing 5 corresponding to the position of the upper longitudinal seal 26, so that the vertical seal 24 can be disposed so as to connect the end portion seal 21 and the lower longitudinal seal 25.

Figure 9:
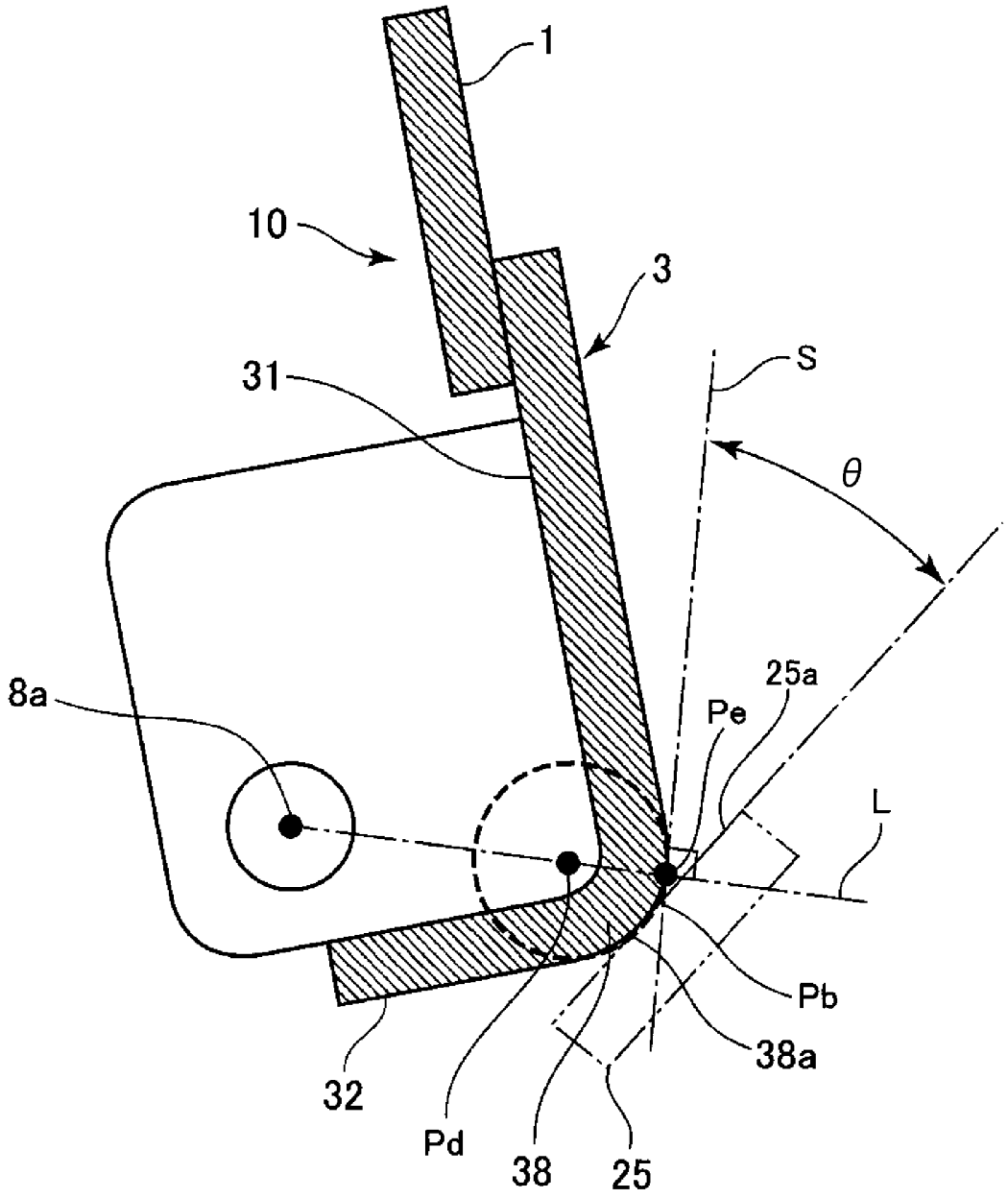
FIG. 9 is a sectional view showing another example of a supporting member.

Further, in this embodiment, the supporting member 2 includes the supporting plate 3 and the swing plate 4, and the lower longitudinal seal 25 is contacted to the arcuate surface 48*a* of the bent portion 48 of the swing plate 4, but the present invention is not limited to such a constitution. As shown in FIG. 9, the supporting member 2 may also be constituted by the supporting plate 3 without including the swing plate 4. This supporting plate 3 is supported swingably by the housing 5 similarly as in the case of the swing plate 4 in this embodiment. In this case, the blade pressing spring 6 contacts the supporting plate 3 and imparts the urging force to the supporting plate 3. Further, in this case, the lower longitudinal seal 25 is contacted to an arcuate surface 38*a* of a bent portion 38 of the supporting plate 3. Even in such a constitution, an effect similar to the effect of this embodiment can be obtained.

Embodiment 2

Next, another embodiment of the present invention will be described. Basic constitution and operation of an image forming apparatus of this embodiment are the same as those in Embodiment 1. Accordingly, elements having identical or corresponding functions or constitutions to those of the image forming apparatus of Embodiment 1 are represented by the same reference numerals or symbols as those in Embodiment 1 and will be omitted from detailed description.

In the embodiment 1, the present invention is applied to the cleaning device 106 which is a cleaning means of the photosensitive member 101 as the rotatable member, but is not limited to such an embodiment. The present invention is also applicable to, for example, the belt cleaning device 140 (FIG. 1) which is a cleaning means for the intermediary transfer belt 107 as the rotatable member.

Figure 10:
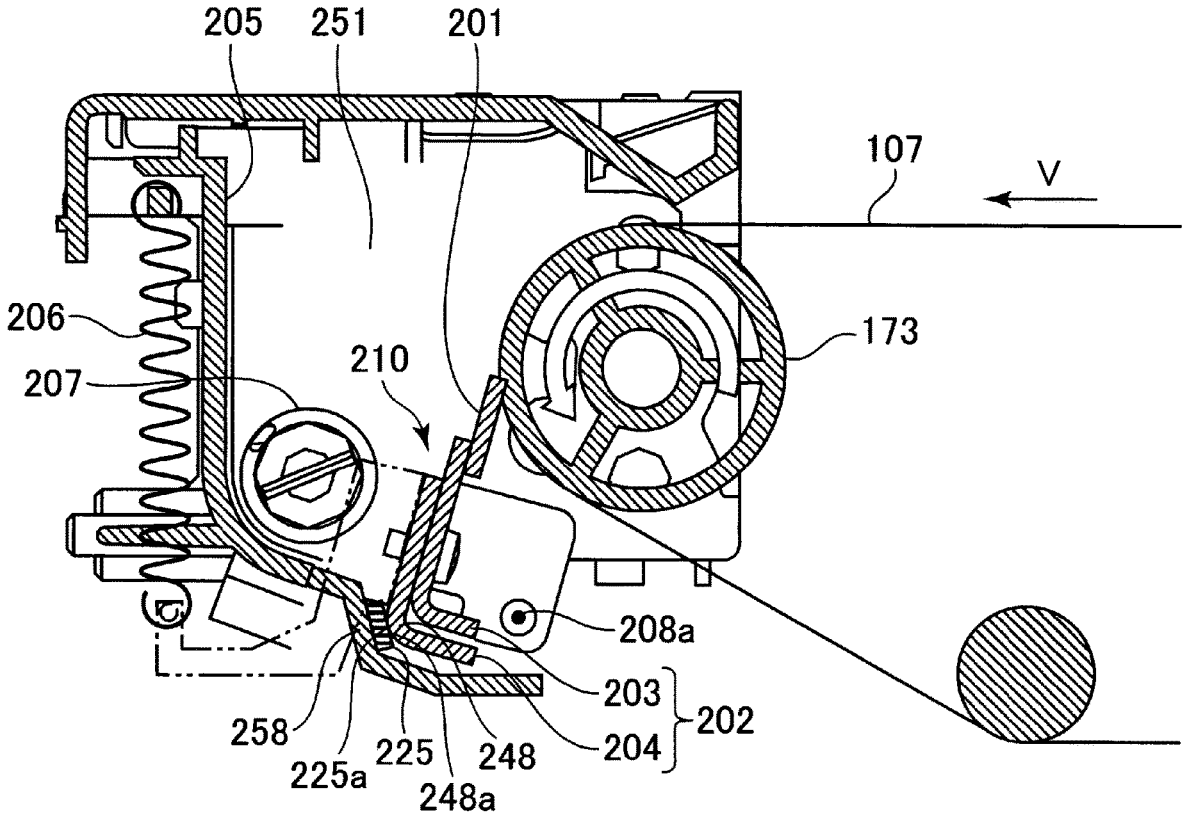
FIG. 10 is a sectional view showing a belt cleaning device.
Figure 11:
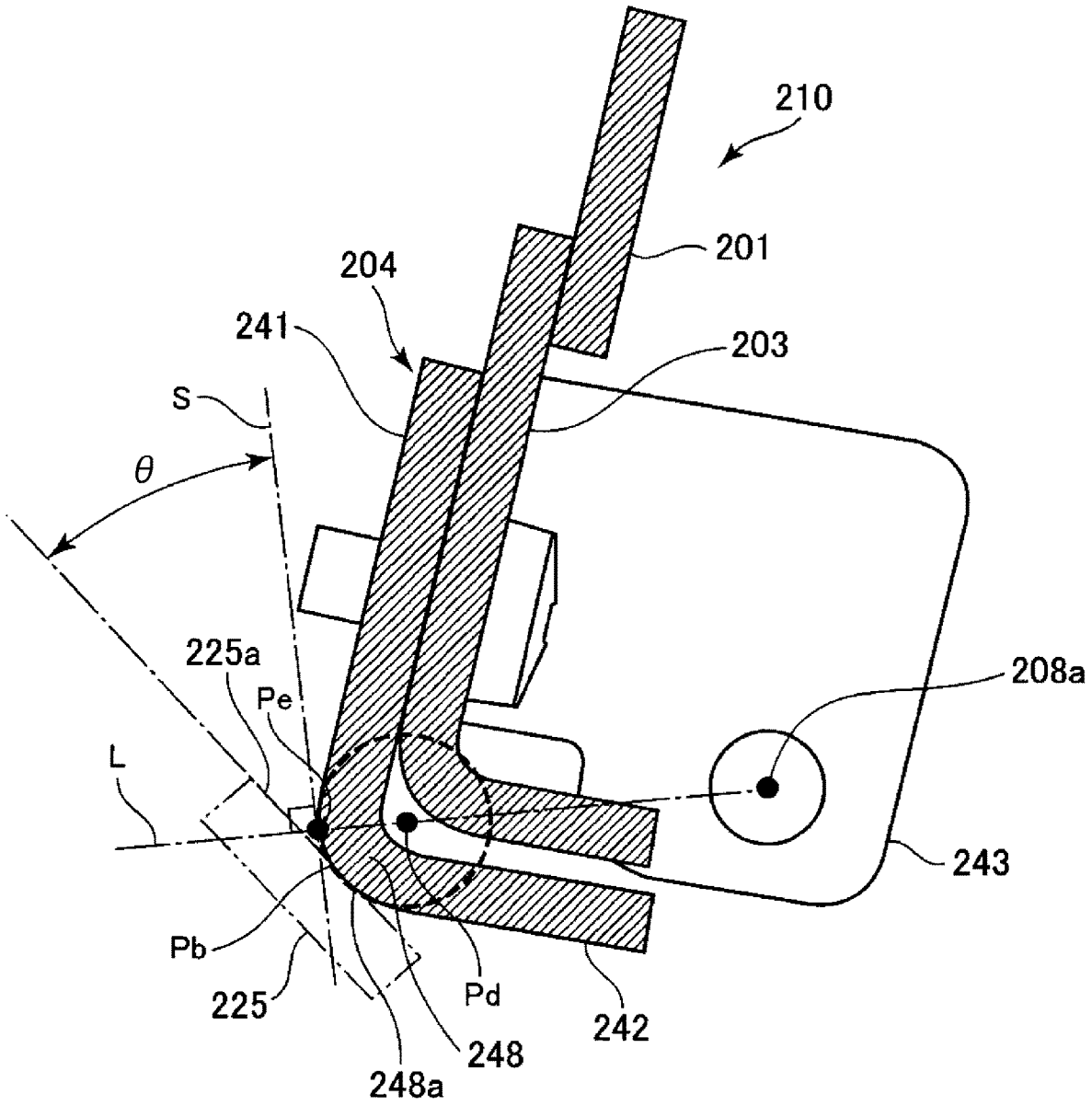
FIG. 11 is a sectional view for illustrating an arrangement of a sealing member.

FIG. 10 is a sectional view (cross section substantially perpendicular to the rotational axis direction of the tension roller 173) showing the belt cleaning device 140 and peripheral component parts thereof in this embodiment. Incidentally, in the belt cleaning device 140, elements having corresponding functions and constitutions to those of the cleaning device 106 in the embodiment 1 are represented by corresponding reference numerals or symbols of 200*s* and will be omitted from detailed description. For example, in FIG. 11, swing plate 204 is formed by bending a metal plate so as to include a first flat portion (flat surface portion) 241, a second flat portion (flat surface portion) 242, and a holding portion 243. FIG. 11 is a sectional view (cross section substantially perpendicular to the longitudinal direction of a cleaning blade 201) for illustrating an arrangement of a lower longitudinal seal 225 in this embodiment.

The belt cleaning device 140 is provided mountable to and dismountable from the intermediary transfer belt unit 112. Thus, in this embodiment, the rotatable member which is the cleaning object of the cleaning blade 201 is the intermediary transfer belt 107 backed-up by the rollers. Further, in this embodiment, the cleaning device 140 is capable of being mounted to and dismounted from the intermediary transfer belt unit 112 mountable in and dismountable from the image forming apparatus 100.

The cleaning blade 201 contacts the surface of the intermediary transfer belt 107 backed-up by the tension roller 173 and removes the residual toner on the intermediary transfer belt 107. The cleaning blade 201 is fixed to a supporting plate 203, and the supporting plate 203 is fixed to a swing plate 204. A supporting member 202 is constituted by including the supporting plate 203 and the swing plate 204. Further, a blade assembly 210 is constituted by including the cleaning blade 201 and the supporting member 202 (supporting plate 203, swing plate 204). At the secondary transfer portion N2, the toner images transferred onto the recording material P, and thereafter, the residual toner remaining on the intermediary transfer belt 107 is carried to the belt cleaning device 140 by the intermediary transfer belt 107 rotating in an arrow V direction in FIG. 10. The residual toner on the intermediary transfer belt 107 is removed from the intermediary transfer belt 107 by the cleaning blade 201 and is accommodated in a collected toner accommodating portion 251 of a housing 205. The collected toner is fed in, for example, the front direction on the drawing sheet of FIG. 10 by a feeding screw 207 in the collected toner accommodating portion 251, and is discharged from the housing 205 (belt cleaning device 140).

The swing plate 204 is supported swingably (rotatably) by the housing 205 via a swing shaft 208*a*. Further, between the swing plate 204 and the housing 205, a blade pressing spring 206 constituted by a tensile spring which is the pressing member as the urging means is provided. The blade pressing spring 206 imparts the urging force to the swing plate 204, and thus presses the cleaning blade 201 against the intermediary transfer belt 107 backed-up by the tension roller 173. The blade pressing spring 206 constituted by the tensile spring is connected to the swing plate 204 at one end portion thereof, and is connected to the housing 205 at the other end portion thereof. Incidentally, the blade pressing spring 206 is provided at each of opposite end portions of the swing plate 204 with respect to the longitudinal direction, but is represented in a superposed state with a cross-sectional portion in FIG. 10. In this embodiment, in the cross section shown in FIG. 10, the swing shaft 208*a* of the supporting member 202 is positioned within a region where the supporting member 202 is projected on the rotatable member 107 side along the thickness direction of the cleaning blade 201 and within a region where the tension roller 173 backing up the rotatable member 107 at a position where the cleaning blade 201 contacts the rotatable member 107 is projected on the supporting member 202 side along the widthwise direction of the cleaning blade 201, and is substantially parallel to the longitudinal direction of the cleaning blade 201. Further, in this embodiment, the lower longitudinal seal 225 corresponding to the lower longitudinal seal 25 in the embodiment 1 is intimately contacted and fixed to a seal bonding surface 258 of the housing 205 by double-side tape, for example.

Similarly as in the lower longitudinal seal 25 in the embodiment 1, the lower longitudinal seal 225 contacts an arcuate surface 248*a* of a bent portion 248 of the swing plate 204.

Further, in a cross section shown in FIG. 11, a rectilinear line connecting the swing shaft 208*a* of the swing plate 204 and a curved surface center Pd which is a center of the arcuate surface 248*a* of the bent portion 248 of the swing plate 204 is a rectilinear line L. Further, in the cross section shown in FIG. 11, a rectilinear line (tangential line of an arc) perpendicular to the rectilinear line L at a point of intersection Pe of the rectilinear line L and the arcuate surface 248*a* of the bent portion 248 is a rectilinear line S. Further, in the cross section shown in FIG. 11, an angle formed by the rectilinear line S and a contact surface 225*a* of the lower longitudinal seal 225 which is a surface (flat surface) contacting the swing plate 204 is a contact angle θ. In this case, the contact angle θ may preferably be 40° or less. That is, the seal bonding surface 258 may preferably be provided on the housing 205 so that the contact angle θ is 40° or less. Incidentally, the contact angle θ may most preferably be 0°. By this, similarly as in the embodiment 1, it is possible to alleviate the sliding resistance between the bent portion 248 of the swing plate 204 and the lower longitudinal seal 225.

Incidentally, similarly as described in the embodiment 1, the supporting member 202 may also be constituted by the supporting plate 203 without including the swing plate 204.

As described above, an effect similar to the effect of the embodiment 1 can be obtained also by applying the present invention to the belt cleaning device 140.

Other Embodiments

As described above, the present invention was described in accordance with specific embodiments, but the present invention is not limited to the above-described embodiments. In the above-described embodiments, the case where the rotatable member as the cleaning object of the cleaning device is the photosensitive drum and the intermediary transfer belt was described. However, the rotatable member as a cleaning object of the cleaning device is not limited to the photosensitive drum and the intermediary transfer belt. The rotatable member as the cleaning object of the cleaning device is, for example, a recording material carrying belt constituted by an endless belt, as a recording material carrying member for carrying and conveying the recording material onto which the toner image formed on the image bearing member such as the photosensitive drum is transferred. Further, in addition, the rotatable member may also be a photosensitive belt, an electrostatic dielectric (member) belt, or belts as a rotatable member and a rotatable pressing member which are provided in the image heating device for heating the recording material. That is, typically, the rotatable member as the cleaning object of the cleaning device in an image conveying member for conveying the toner image or the recording material carrying thereon the toner image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-155024 filed on Sep. 15, 2020, which is hereby incorporated by reference herein in its entirety.

What is claimed is:

1. A cleaning device comprising:

a cleaning blade configured to remove toner from a surface of a rotatable member in contact with the surface of the rotatable member;

a supporting member supporting said cleaning blade;

a housing configured to swingably hold said supporting member;

a pressing member provided between said supporting member and said housing and pressing said supporting member so as to press said cleaning blade against the rotatable member, wherein said supporting member is a metal member and is extended in a longitudinal direction of said cleaning blade, said supporting member including a first flat surface portion formed along a widthwise direction of said cleaning blade, a curved surface portion bent toward the rotatable member with respect to a thickness direction of said cleaning blade, and a second flat surface portion formed along the thickness direction of said cleaning blade, and wherein as viewed in the longitudinal direction, a swing center of said supporting member is positioned on a rotation center side of the rotatable member relative to a plane including said first flat surface portion and relative to a plane including said second flat surface portion; and a sealing member provided in contact with said curved surface portion and sealing between said supporting member and said housing.

2. A cleaning device according to claim 1, wherein in a cross section substantially perpendicular to the longitudinal direction, a distance from the swing center to a contact position between said sealing member and said curved surface portion is shorter than a distance from the swing center to a load point where said pressing member imparts an urging force to said supporting member.

3. A cleaning device according to claim 1, wherein in a cross section substantially perpendicular to the longitudinal direction, said curved surface portion is an arcuate surface, and when a rectilinear line connecting the swing center and a center of said arcuate surface is a first rectilinear line, a rectilinear line perpendicular to the first rectilinear line at a point of intersection of the first rectilinear line and said arcuate surface is a second rectilinear line, and an angle formed by the second rectilinear line and a contact surface, of said sealing member, which is a surface where said sealing member contacts said arcuate surface is a contact angle, the contact angle is 40° or less.

4. A cleaning device according to claim 1, wherein in a cross section substantially perpendicular to the longitudinal direction, said curved surface portion is an arcuate surface, and further comprising a second sealing member provided between said supporting member and said housing so as to contact said supporting member on the rotatable member side relative to said arcuate surface with respect to the widthwise direction, wherein a length of said sealing member with respect to the longitudinal direction is longer than a length of said second sealing member with respect to the longitudinal direction.

5. A cleaning device according to claim 4, wherein in a cross section substantially perpendicular to the longitudinal direction, a distance from said swing center to a contact position between said second sealing member and said supporting member is longer than a distance from said swing center to a load point where said pressing member imparts an urging force to said supporting member.

6. A cleaning device according to claim 4, wherein said sealing member is disposed in a region including a central portion of said supporting member with respect to the longitudinal direction, and said second sealing member is disposed on each of opposite end portion sides of said supporting member with respect to the longitudinal direction.

7. A cleaning device according to claim 6, wherein said second sealing member is provided above said pressing member in a region in which said pressing member is disposed with respect to the longitudinal direction.

8. A cleaning device according to claim 7, further comprising a third sealing member connecting said sealing member and said second sealing member.

9. A cleaning device according to claim 1, wherein said supporting member is configured to include said metal member and a second metal member which is fixed to said metal member and to which said cleaning blade is fixed.

10. A cleaning device according to claim 1, wherein the rotatable member is a cylindrical photosensitive member.

11. A cleaning device comprising:

a cleaning blade configured to remove toner from a belt for carrying a toner image in contact with an outer peripheral surface of the belt, wherein said cleaning blade is provided opposed via said belt to a roller supporting an inner surface of said belt;

a supporting member supporting said cleaning blade;

a housing configured to swingably hold said supporting member;

a pressing member provided between said supporting member and said housing and pressing said supporting member so as to press said cleaning blade against the belt, wherein said supporting member is a metal member and is extended in a longitudinal direction of said cleaning blade, said supporting member including a first flat surface portion formed along a widthwise direction, a curved surface portion bent toward said belt with respect to a thickness direction of said cleaning blade, and a second flat surface portion formed along the thickness direction of said cleaning blade, and wherein as viewed in the longitudinal direction, a swing center of said supporting member is positioned on a center side of said belt relative to a plane including said first flat surface portion and relative to a plane including said second flat surface portion; and a sealing member provided in contact with said curved surface portion and sealing between said supporting member and said housing.

* * * * *